US007264263B2

(12) United States Patent
Riedel et al.

(10) Patent No.: US 7,264,263 B2
(45) Date of Patent: Sep. 4, 2007

(54) SKI BINDING

(75) Inventors: Tilo Riedel, Freilassing (DE); Bernt-Otto Hauglin, Røyken (NO)

(73) Assignee: Rottefella A/S, Klokkarstua (NO)

( * ) Notice: Subject to any disclaimer, the term of this patent is extended or adjusted under 35 U.S.C. 154(b) by 515 days.

(21) Appl. No.: 10/221,065

(22) PCT Filed: Mar. 7, 2001

(86) PCT No.: PCT/IB01/00326

§ 371 (c)(1),
(2), (4) Date: Jan. 21, 2003

(87) PCT Pub. No.: WO01/66204

PCT Pub. Date: Sep. 13, 2001

(65) Prior Publication Data

US 2003/0155742 A1 Aug. 21, 2003

(51) Int. Cl.
*A63C 9/08* (2006.01)

(52) U.S. Cl. ..... 280/614; 280/615; 280/618

(58) Field of Classification Search ..... 280/611, 280/613, 614, 615, 617, 618, 619, 620, 621, 280/623, 624, 625, 626
See application file for complete search history.

(56) References Cited

U.S. PATENT DOCUMENTS 3,752,491 A * 8/1973 Fend ..... 280/618
3,813,109 A * 5/1974 Salomon ..... 280/618
3,825,273 A * 7/1974 Greene ..... 280/618
3,863,942 A * 2/1975 Burger ..... 280/621
3,900,205 A * 8/1975 Sittmann ..... 280/618
3,901,523 A * 8/1975 Burger ..... 280/614
3,997,188 A * 12/1976 Begey ..... 280/613
4,088,342 A * 5/1978 Hausleithner ..... 280/614
4,182,524 A * 1/1980 Beyl ..... 280/618
4,322,090 A * 3/1982 Loughney ..... 280/614
4,854,605 A * 8/1989 Emerson ..... 280/615
4,887,833 A * 12/1989 Bailey ..... 280/615

(Continued)

FOREIGN PATENT DOCUMENTS

DE 3412073 10/1985

(Continued)

*Primary Examiner*—Christopher P. Ellis
*Assistant Examiner*—Bridget Avery
(74) *Attorney, Agent, or Firm*—Andrus, Sceales, Starke & Sawall, LLP

(57) ABSTRACT

Ski binding, in particular a touring, telemark or cross-country binding, with a front retaining element associated with the front end of the sole, a back retaining element designed to engage the front part of the sole of a ski boot or the heel of the boot and a tensioning device connecting the front and back retaining elements to one another, which allows the front and back retaining elements to be locked to the ski boot and, in particular, allows the heel of the boot to be raised from the ski while in the locked state, such that at least one spring-loaded release mechanism is associated with the tensioning device in order to release the lock between ski binding and ski boot under the action of a torque that exceeds a specified threshold magnitude and is exerted on the ski or boot about an upright axis of rotation, and/or of a force manually exerted on an essentially only positive-fit locking element.

20 Claims, 15 Drawing Sheets

U.S. PATENT DOCUMENTS

| | | | | | |
|---|---|---|---|---|---|
| 5,224,730 | A | * | 7/1993 | Provence et al. | 280/615 |
| 5,318,320 | A | * | 6/1994 | Ramer | 280/614 |
| 5,499,838 | A | * | 3/1996 | Hauglin et al. | 280/615 |
| 5,518,264 | A | * | 5/1996 | Broughton | 280/615 |
| 5,669,622 | A | * | 9/1997 | Miller | 280/615 |
| 5,727,808 | A | * | 3/1998 | Broughton | 280/615 |
| 5,897,127 | A | * | 4/1999 | Hauglin | 280/615 |
| 5,947,507 | A | * | 9/1999 | Quintana et al. | 280/615 |
| 6,017,050 | A | * | 1/2000 | Girard | 280/615 |
| 6,209,903 | B1 | * | 4/2001 | Girard | 280/615 |
| 6,308,979 | B1 | * | 10/2001 | Ludlow | 280/615 |
| 6,390,493 | B1 | * | 5/2002 | Hauglin | 280/615 |
| 6,435,537 | B2 | * | 8/2002 | Veux | 280/615 |
| 6,685,213 | B2 | * | 2/2004 | Hauglin | 280/624 |

FOREIGN PATENT DOCUMENTS

| | | |
|---|---|---|
| EP | 0908204 | 4/1999 |
| EP | 0951926 | 10/1999 |

* cited by examiner

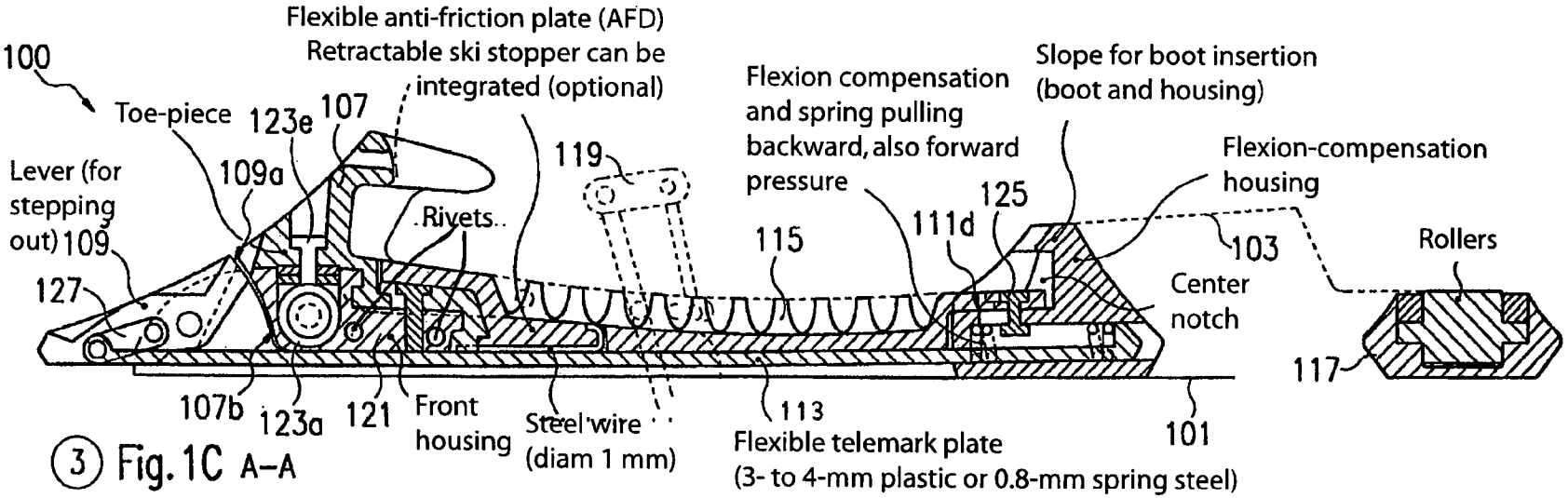
③ Fig. 1C A–A
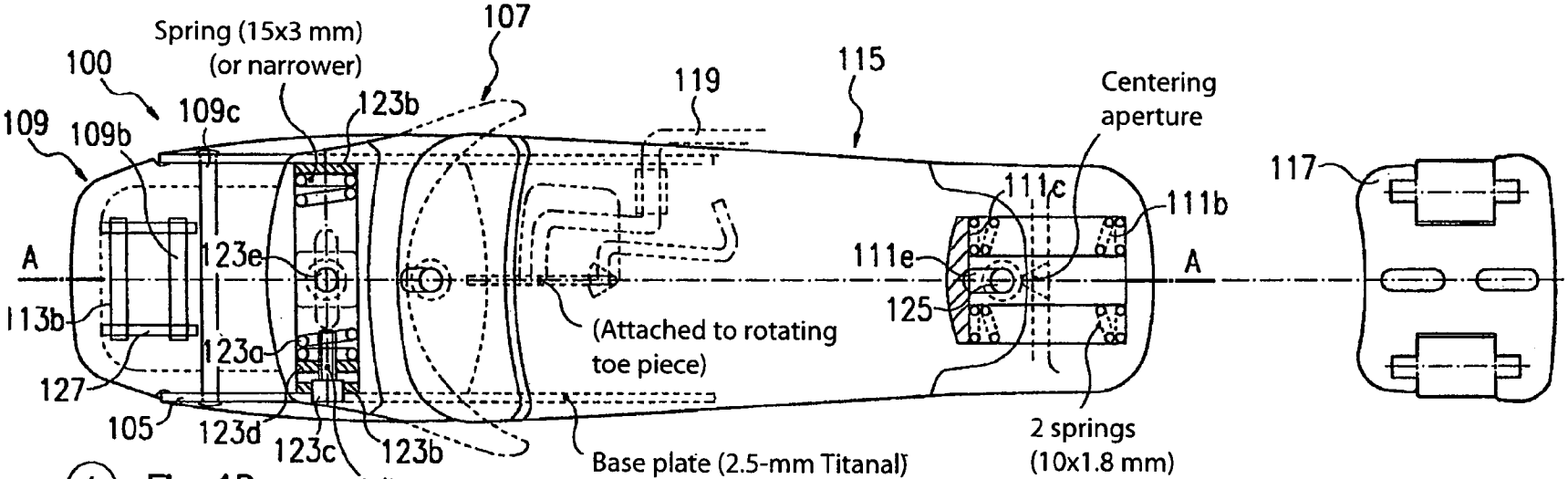
④ Fig. 1D

7

8

(14) Improved torsional stability with connections (joints)
(Tyrolia had a touring ski binding with more than one connection, 20 years ago)

(15) Extreme bending position

Figure 8A:
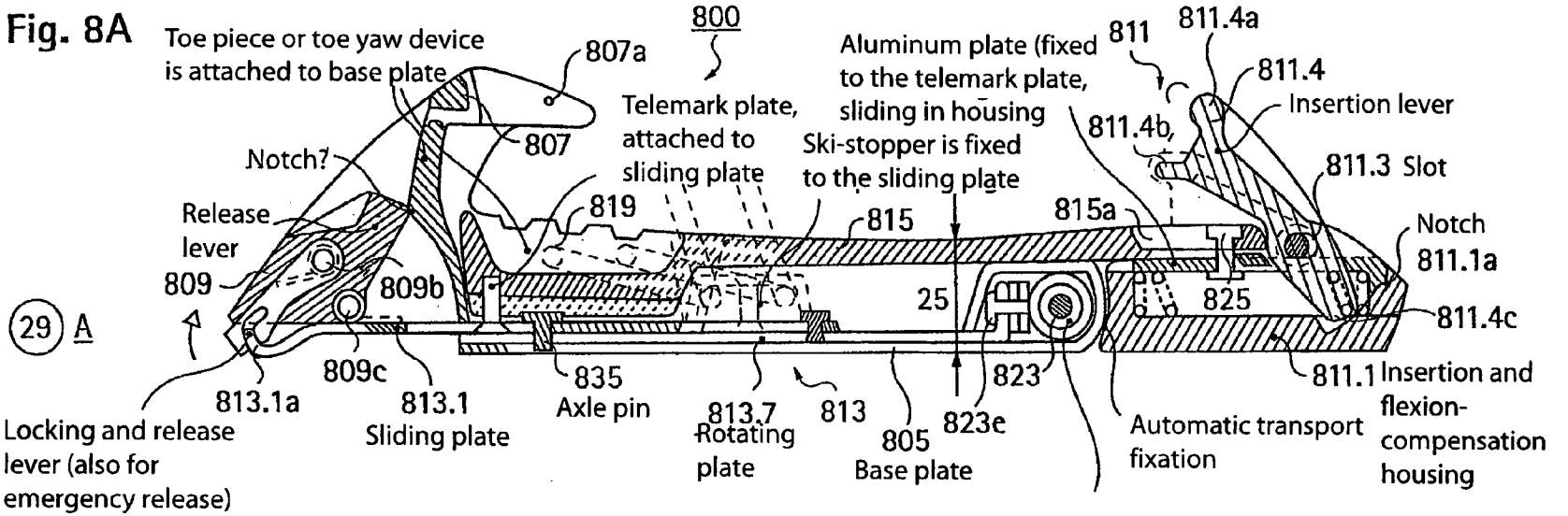
Figure 8B:
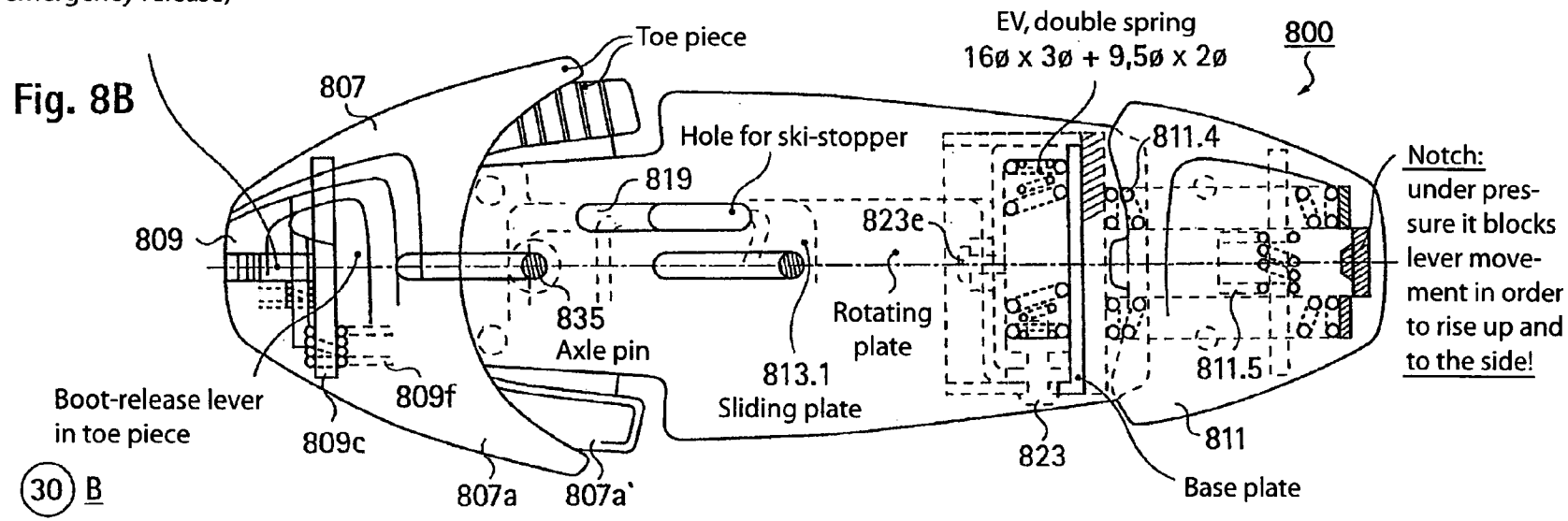
Figures 9A, 9B, 9C, 9D:
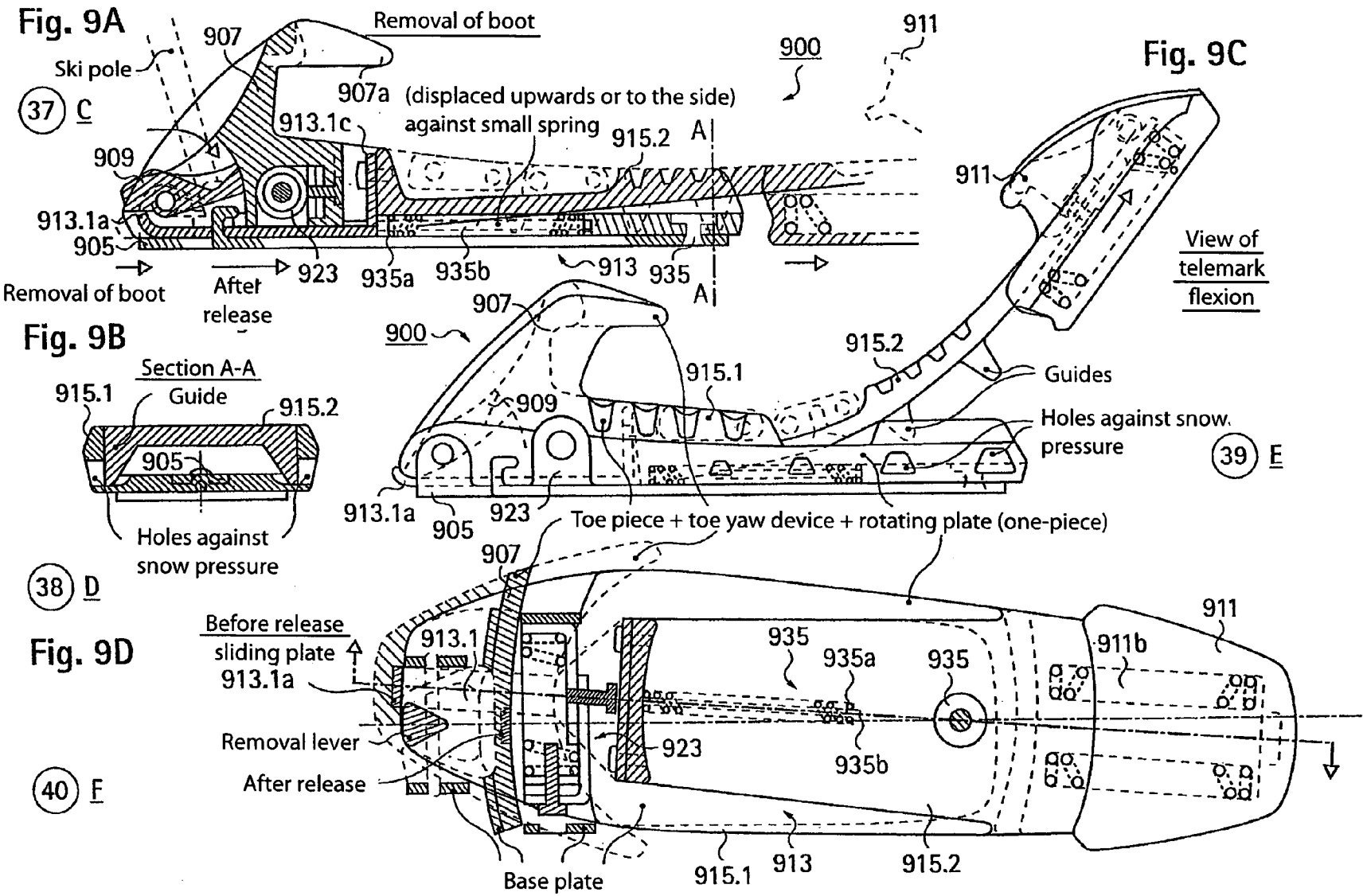

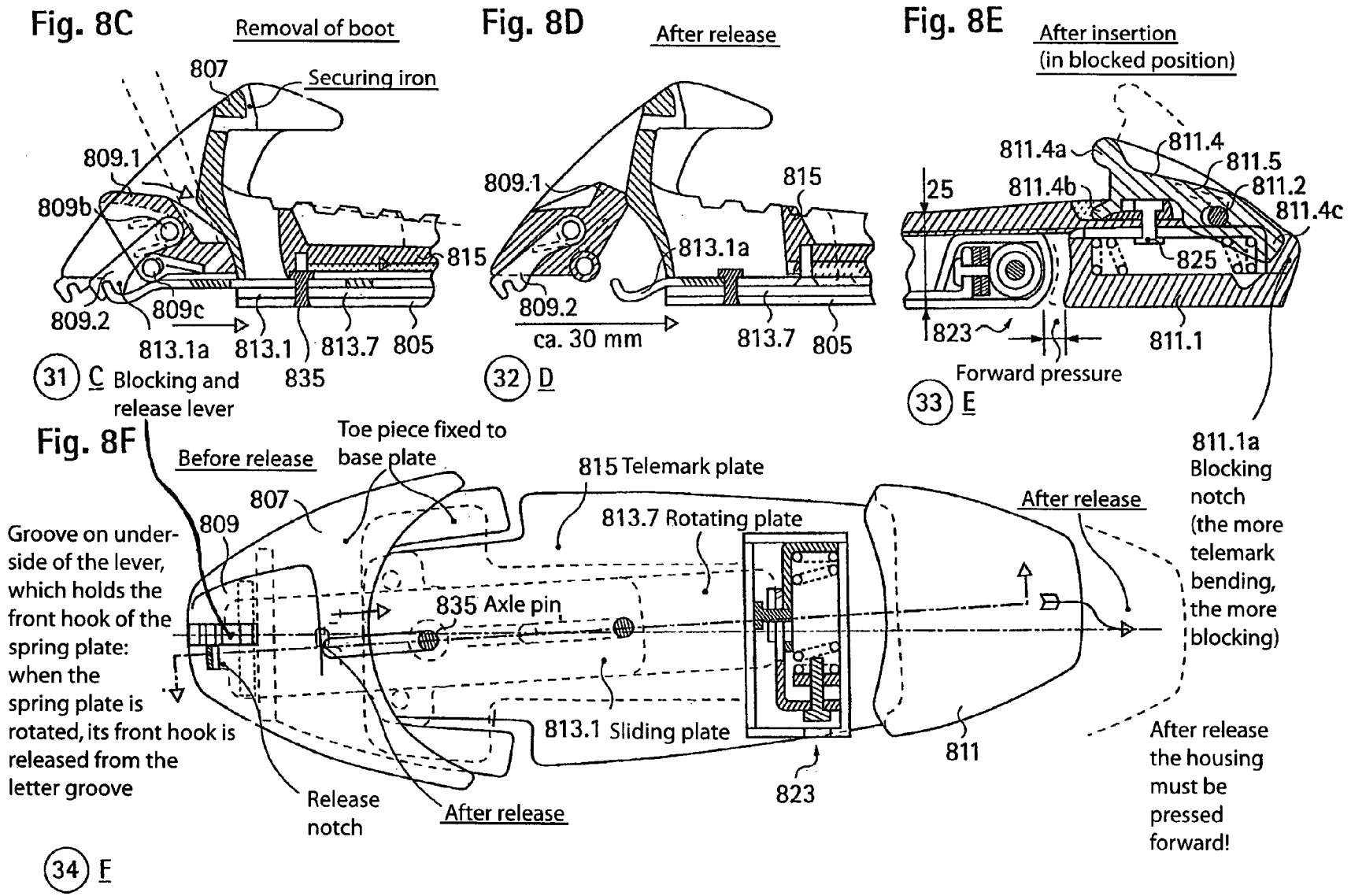
Fig. 8C
Removal of boot
Securing iron
807
809.1
809b
809.2
809c
813.1a
813.1
835
813.7
805
815
31 C Blocking and release lever
Fig. 8D
After release
809.1
809.2
ca. 30 mm
813.1a
815
813.7
805
32 D
Fig. 8E
After insertion (in blocked position)
811.4a
811.4b
811.4
811.5
811.2
811.4c
825
811.1
823
25
Forward pressure
33 E
811.1a Blocking notch (the more telemark bending, the more blocking)
Fig. 8F
Before release
Toe piece fixed to base plate
807
809
Groove on underside of the lever, which holds the front hook of the spring plate: when the spring plate is rotated, its front hook is released from the letter groove
After release
815 Telemark plate
813.7 Rotating plate
835 Axle pin
813.1 Sliding plate
Release notch
After release
After release the housing must be pressed forward!
811
823
34 F Ski pole
37 C
907
909
913.1a
905
Removal of boot
907a
913.1c
Removal of boot
(displaced upwards or to the side)
against small spring
915.2
913
935
935b
935a
923
After release
900
911

Section A-A
Guide
915.2
905
915.1
Holes against snow pressure

View of telemark flexion
911
Guides
Holes against snow pressure
39 E
915.2
915.1
907
909
900
923
905
913.1a
Toe piece + toe yaw device + rotating plate (one-piece)
38 D 911
911b
935
935a
935b
915.2
913
915.1
923
907
913.1
Base plate
Before release
sliding plate
913.1a
Removal lever
After release
40 F

SKI BINDING

The invention relates to a ski binding according to the precharacterizing clause of Claim 1.

In contrast to bindings for downhill skiing, a crucial functional feature of touring, telemark or cross-country ski bindings is that although the associated ski boot is attached to the ski at the front end of the sole by a retaining element, the back end of the sole (the heel) is not permitted to be fixed to the ski but rather must be able to be lifted away from the ski. This elementary requirement, which arises from the sequence of movements associated with touring or cross-country skiing as well as with skiing downhill in the telemark style, is ordinarily fulfilled in previous binding constructions by means such that the guidance properties of the binding are impaired.

For years, however, cross-country, touring and telemark bindings have been known and in practical use that achieve good lateral guidance by means of appropriate engagement sections on the binding and on a boot adapted thereto, at least when the ski boot is set down onto the binding.

The German patent DE 34 12 073 C2 discloses a cross-country safety ski binding in which a flexible plate attached to the ski, with a posterior rotatory bearing, guides the boot laterally relatively well even when the boot is raised away from the ski and, furthermore, fundamentally permits release of the retaining mechanism when the ski boot is placed under torsional load. For the sliding phase, in which the boot is set onto the ski, extra stabilizing elements are also provided.

The patent EP 0 806 977 B1 discloses a ski binding according to the precharacterizing clause of Claim 1. In an advantageous embodiment this binding comprises a tensioning element that engages the undersurface of the front part of the boot sole and in particular is constructed as a flexurally elastic part in the form of a band or leaf spring.

This ski binding provides good guidance and force transmission, but even here there is a need for improvement, in particular with respect to its safety properties and to simple operation with little expenditure of force.

The objective of the present invention is thus to develop further a ski binding of this generic kind, with the aim of creating an easily operated safety ski binding designed for cross-country and touring skiing as well as downhill skiing in telemark style.

This objective is achieved with respect to at least one of its fundamental aspects by a ski binding with the characteristics given in Claim 1.

The invention incorporates the basic idea that in association with the tensioning device in the prior-art binding (or in the region of the front and/or back retaining element) there is provided a releasing mechanism, which in particular is responsive to pressure and unlocks the ski boot when the latter is placed under torsional load, so as to cause the boot to be released from the binding.

By providing an actuating element that responds to pressure (preferably from above) so as to cause a positive-fit locking device to become unlocked, instead of the known "over-the-center" closing and tensioning device, the operation of the binding is considerably simplified, which constitutes a first substantial advantage in terms of usefulness. The provision of a release mechanism that is actuated when ski or boot is under torsional load endows the binding with features of a genuine safety binding. As a result an additional substantial increase in serviceability is achieved.

In a preferred embodiment the ski binding in accordance with the invention comprises both a first release mechanism, which can be triggered when a lateral or torsional force acts on the ski or boot, and a second release mechanism, with an actuating element that responds to a force directed substantially perpendicular to the ski surface. A ski binding with this combination of functions is a qualitatively novel type of binding for touring, telemark or cross-country skiing.

In another preferred embodiment the first and second release mechanisms comprise a single, shared first locking element, disposed on the tensioning device of the binding, and in particular in the region of the front retaining element a second locking element is formed for engagement with the first locking element. The first and second locking elements can be brought into and out of engagement with one another by rotating them about an axis perpendicular to the ski surface.

In a special embodiment the first locking element is a locking hook that can be rotated with respect to the axis of rotation, and the second locking element has a lug or groove that can be swiveled about a first axle oriented parallel to the ski surface and perpendicular to the long axis of the ski, but is fixed in its lateral position relative to the ski. This lug can be engaged with or disengaged from the first locking element by swiveling it about the axle, which enables the boot to be removed from or set into the binding. As a result of the rotation between first and second locking element and the change in state of engagement caused thereby, the binding is released under torsional force or is returned to the position for locking. The actuating element is advantageously connected to the second locking element, so that pressure exerted substantially perpendicular to the actuating element enables the engagement between the first and second locking elements to be released and the boot to be removed from the binding.

In the region of the front or back retaining element, or between the two, a spring device is disposed to apply tension to the back retaining element when it is engaged with the ski boot; in another preferred embodiment it is disposed within the front part of the boot sole. Specifically, between the front and back retaining elements a front spring device is provided to apply tension to the first locking element (locking hook) when it is in a position such that it is engaged with the second locking element (the lug), and at the back retaining element a back spring device is provided to apply tension to the back locking element when it is in a position such that it is engaged with the front part of the boot sole (or the back edge of the heel). The two spring devices cooperate to lock and unlock the binding, and the spring force exerted by the back spring device is adjusted to be greater than that of the front spring device. Therefore when the first and second locking elements are no longer engaged with one another, the tensioning device with back retaining element attached thereto is retracted, under the action of the back spring device and against the (weaker) action of the front spring device. The net result is that the back retaining element is no longer locked to the corresponding engagement section of the ski-boot sole (it is released). However, as soon as the ski boot has left the binding, the back spring device is no longer under tension, so that the front spring device can exert its action and return the engagement element to the longitudinal position that enables it to re-engage the second locking element. The binding is then again in "step-in" position, so that the boot can be inserted.

The release mechanism to unlock the binding when lateral or torsional force is acting comprises a restoring element that elastically counteracts any movement of the ski boot about the axis of rotation. This element is preferably a releasing-spring device that can be adjusted so as to determine the unlocking force. In particular, it comprises a coil spring, the spring constant of which can be altered by compressing it with an adjustment screw.

The back retaining element, in an embodiment that independently provides protection and facilitates insertion of the boot, can be actuated by setting the boot onto the binding, by means of a projection on the front part of the boot sole that corresponds in position and shape to the retaining element and points toward the end of the ski. For this purpose it comprises a second axle disposed substantially parallel to the ski surface and perpendicular to the long axis of the ski. In particular, the back retaining element incorporates a lug that points toward the tip of the ski and, when the ski boot is put into place, is pressed down by the undersurface of the projection on the front part of the boot sole; the back element is connected to the back spring device so that it acts like a lever, actuating the retaining element when the boot is set onto the lug against the spring tension generated by the back spring device.

A torsion spring acting on the back retaining element applies pressure so that the latter is swiveled into an open position, and an additional spring-loaded security catch on the lever-like connection ensures that the retaining element cannot rotate into the opening position while its projection is locked into the front part of the sole of the ski boot. This in turn ensures that the heel of the ski boot can be raised from the ski surface without releasing the lock.

At least one of the front and back holding elements in a preferred embodiment has retaining jaws within which the front end of the boot sole or the projection thereon or the back edge of the heel is enclosed.

The tensioning device in a preferred embodiment comprises a planar connecting part capable of bending elastically in a longitudinal plane of the ski binding, by means of which the front and back retaining parts are connected to one another at least indirectly, so that they are substantially stable against rotation. In alternative embodiments the tensioning device comprises several rigid connecting elements connected to one another by joints, or else a tensioning rope.

When a planar connecting part is employed, it is advantageously attached to the front and back spring devices in such a way that it constitutes a spring connection between the front and back retaining elements.

The planar connecting part is laterally guided with respect to the ski, and in particular is guided by the side walls of a binding case attached to the ski, which enclose the side edges of the connecting part. Alternatively or additionally, the guidance can be achieved by longitudinal ribs or grooves in the binding case, which cooperate with corresponding longitudinal grooves or ribs (serving as a "negative form") on the connecting part.

A ski brake is advantageously also integrated into the proposed ski binding, so that even if the ski should become detached while travelling downhill in telemark style, the binding will be provided with substantially the complete set of properties associated with a downhill binding. In particular, the ski brake is attached to the surface of the above-mentioned planar connecting part in such a way that when the ski boot seated on the connecting part is raised, the connecting part rises along with it and remains inactive. In a design such that the flexible connecting plate does not exist in this form, other suitable means should be employed so that when the heel of the boot is lifted, the ski brake remains in its inactive position.

To compensate for the length changes associated with flexion of the tensioning device—in particular the connecting part—when the heel of the boot is raised and lowered, spring means are preferably provided at the back retaining element. In an especially advantageous embodiment this function is taken over by the above-mentioned back spring device, which additionally provides the spring tensioning needed to lock the back retaining element.

Also provided at the back retaining element—in an alternative embodiment also in the region of the front retaining element—are adjustment means to adjust the length of the binding, which advantageously comprise a sliding piece disposed in a longitudinal guide and capable of being fixed in position there (for instance by a fixing screw).

The front spring device in a preferred embodiment comprises a coil spring with long stroke employed as a compression spring, which at one end is braced against a mounting plate for the binding and at the other end is connected to the (second) release mechanism, and with which there is associated, to serve as a guide element, an in particular internally disposed guide rod.

The back spring device preferably comprises two coil springs, symmetrically disposed with respect to the long axis of the binding and each guided within a guide channel, which likewise operate as compression springs.

In the region of the first axle, to provide a restoring force to the actuating element, there is disposed in particular a torsion-spring element and/or a lever device with a pivoted lever, which in particular by means of the torsion-spring element can be "folded" into a closed position above top dead center and, by pressing on a suitably disposed and shaped actuating section, returned to the opening position.

At least in the region of the front retaining element or the tensioning device, a supporting plate is provided onto which the front part of the boot sole can be placed; to avoid functional impairments resulting from collected snow, the upper surface of this plate advantageously has a rough contour. In the embodiment of the invention with a back retaining element that engages the front part of the boot sole, behind this there is additionally provided a supporting element for the heel of the boot, for which a rough contour is likewise useful.

Figure 1A:
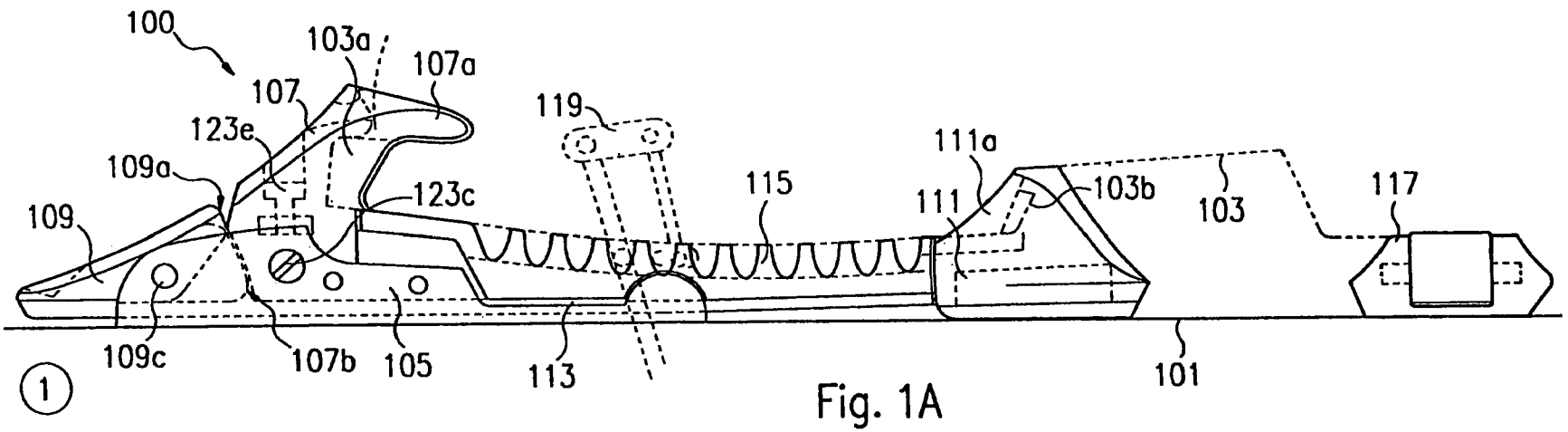
Figure 1B:
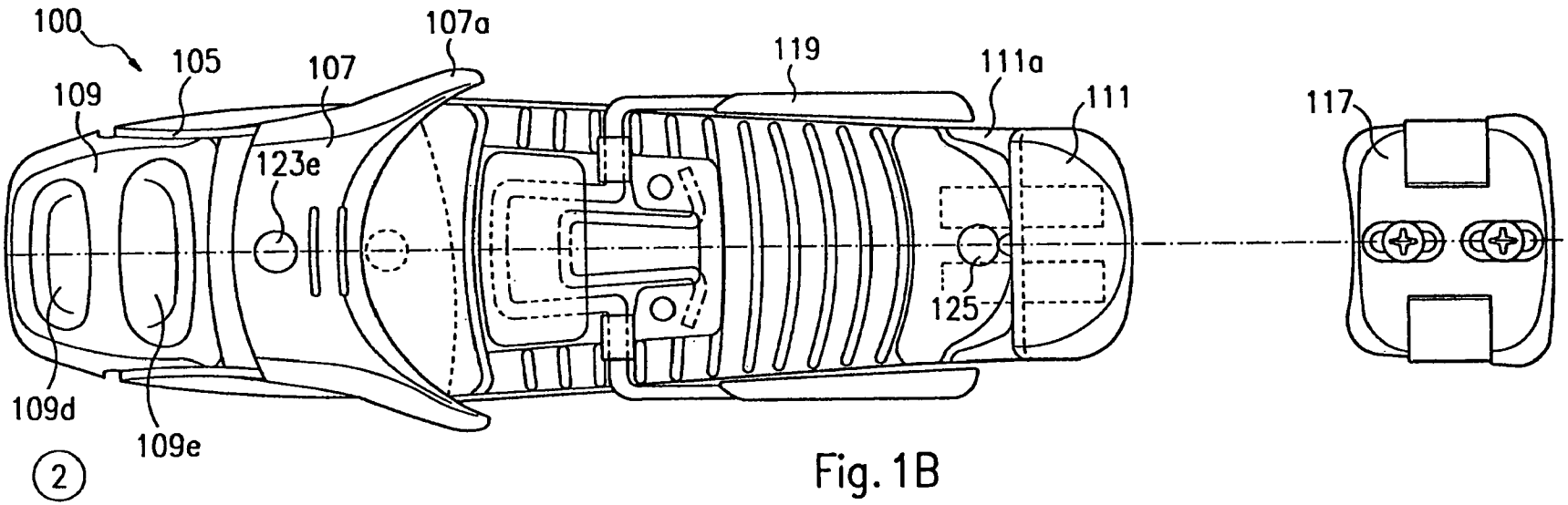
Figure 1E:
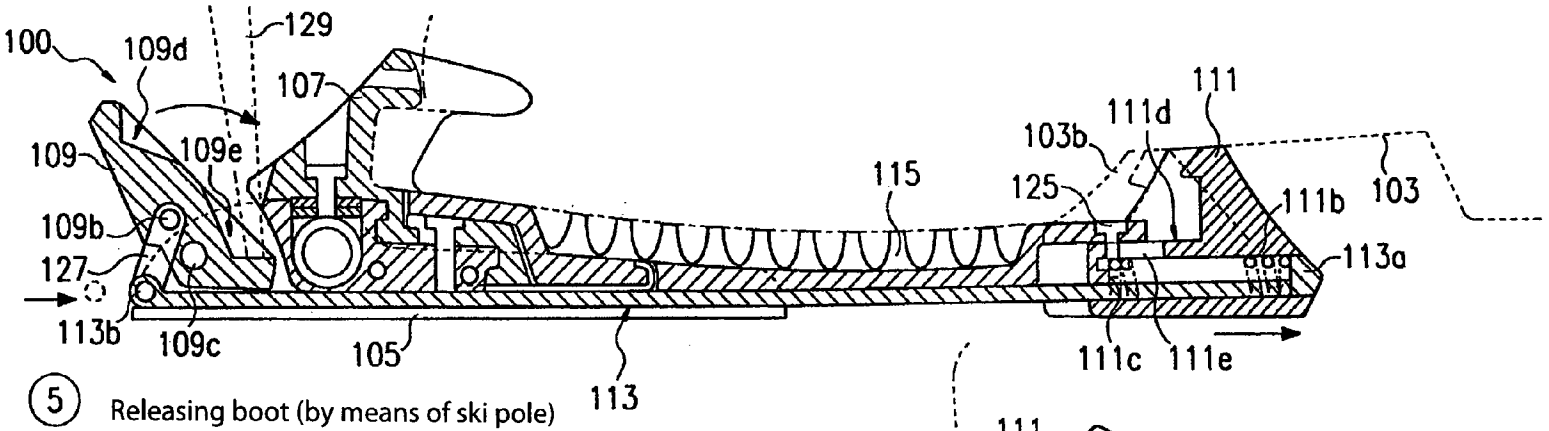
Figure 1F:
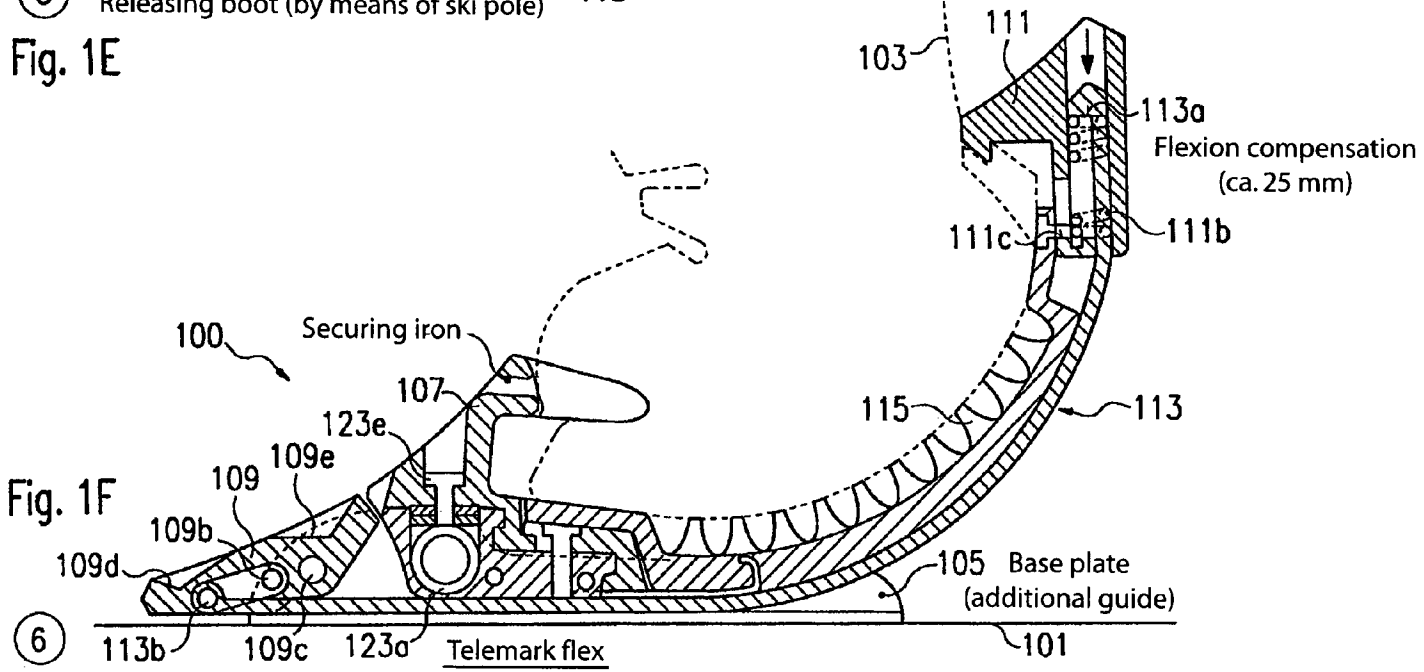
Figures 2A, 2B, 2C, 2D:
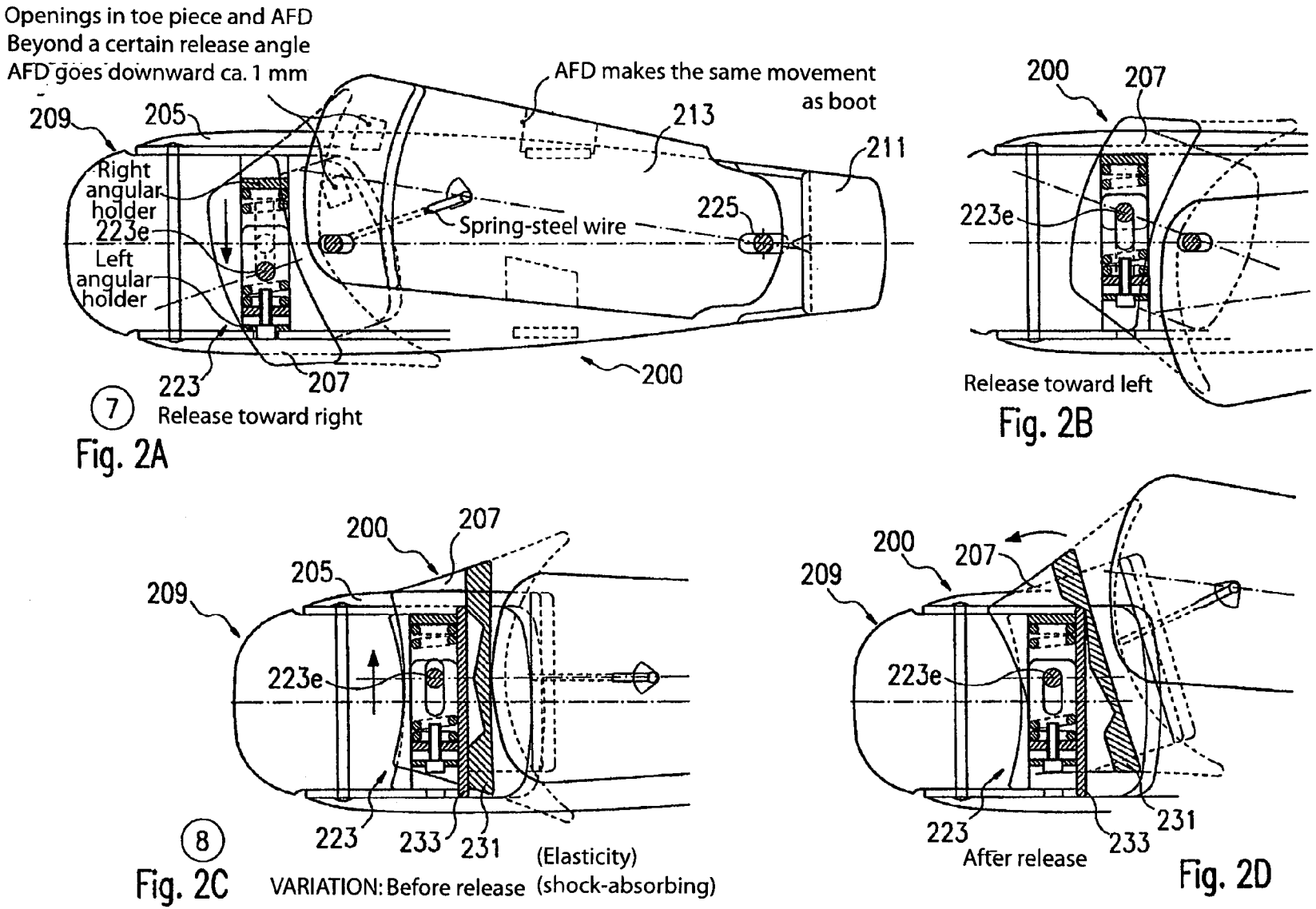
Figure 3A:
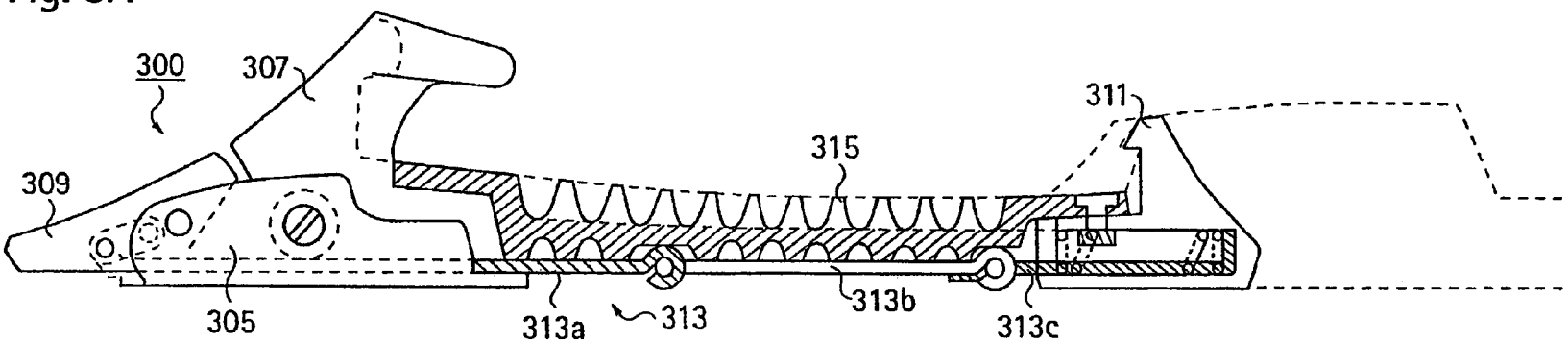
Figure 3B:
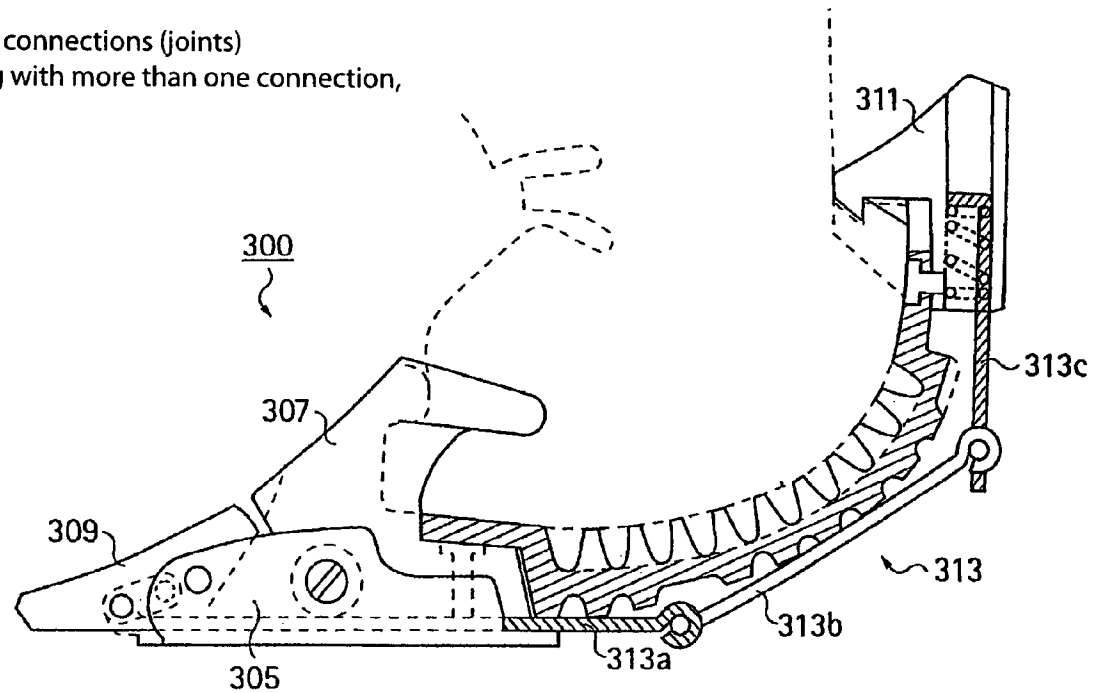
Figures 4A, 4B, 4C:
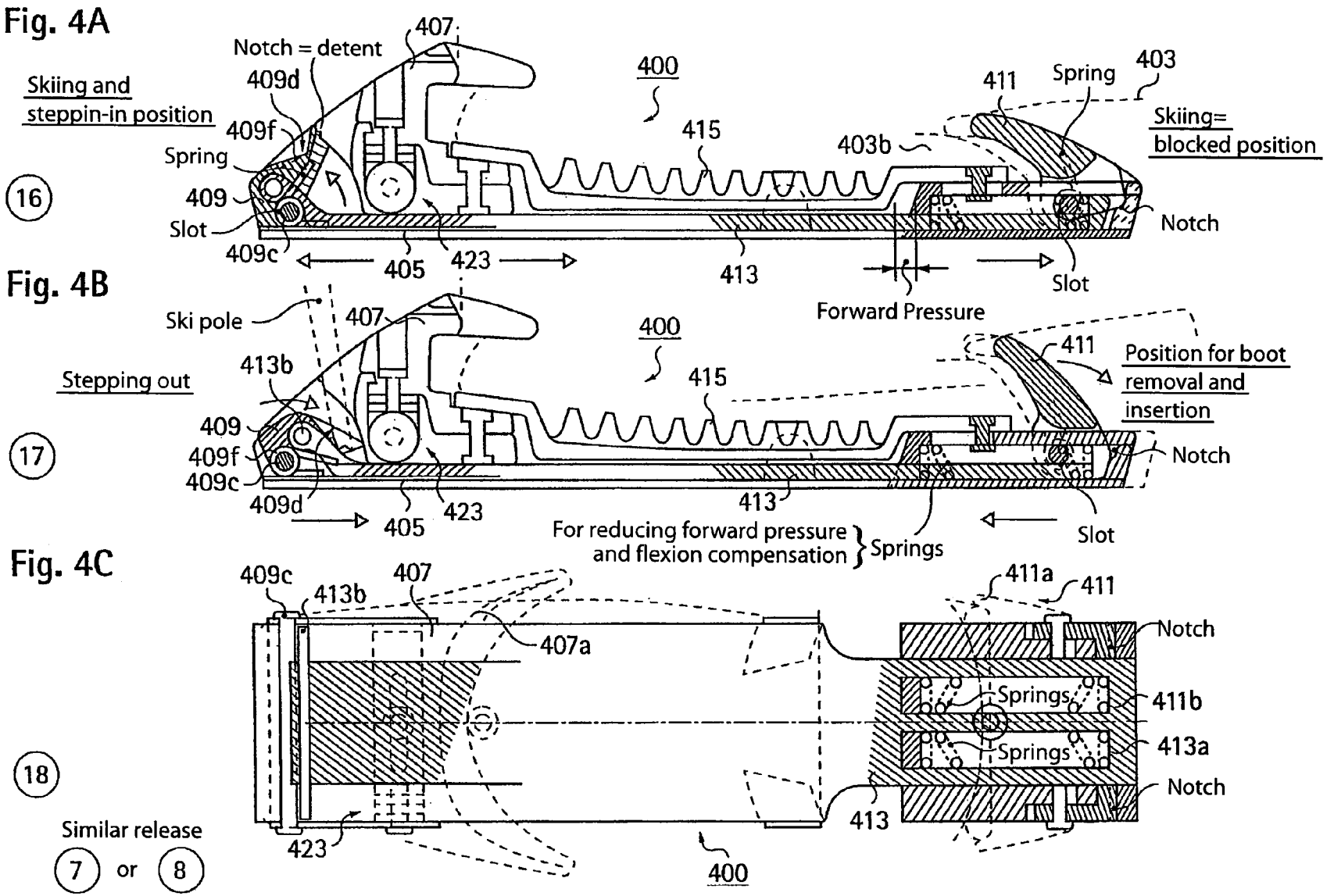
Figure 5A:
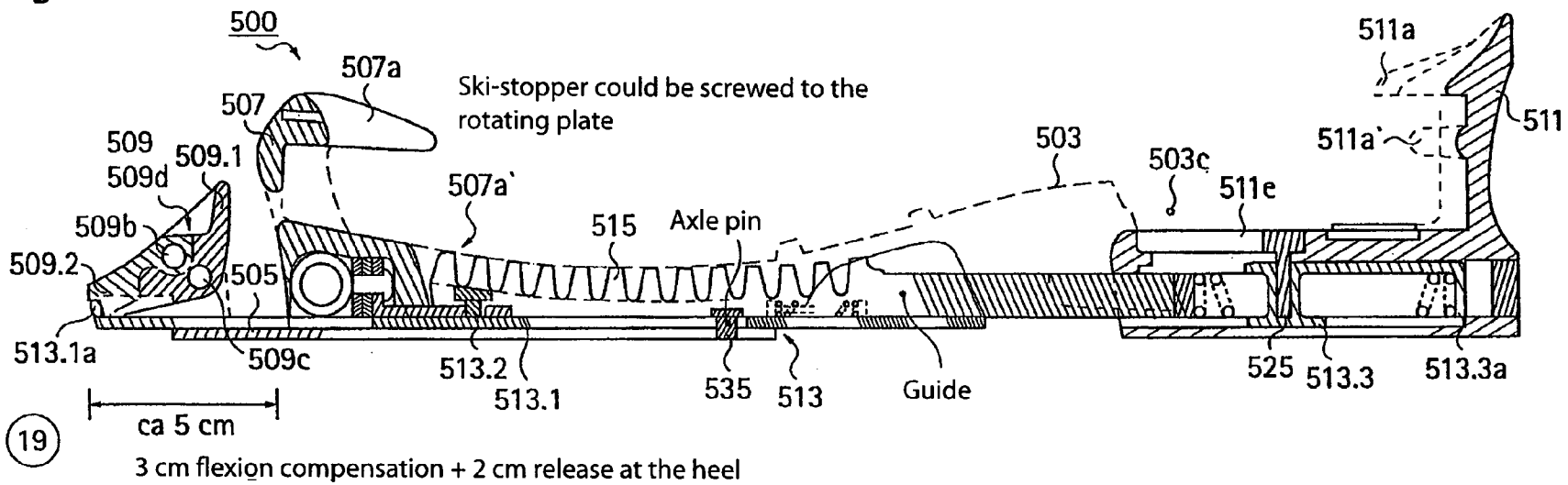
Figure 5B:
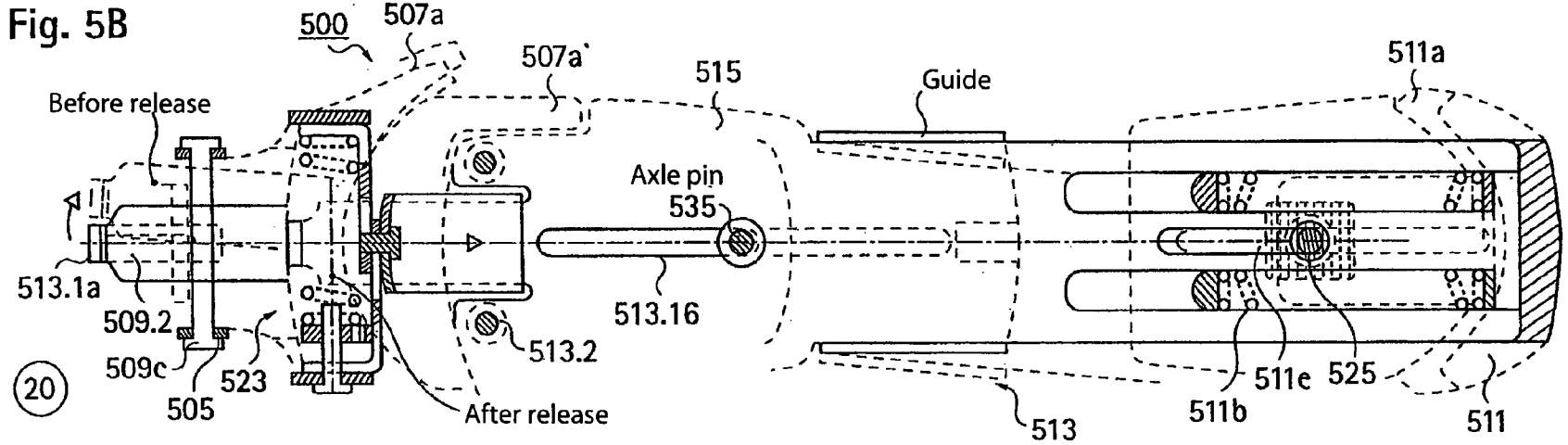
Figure 6A:
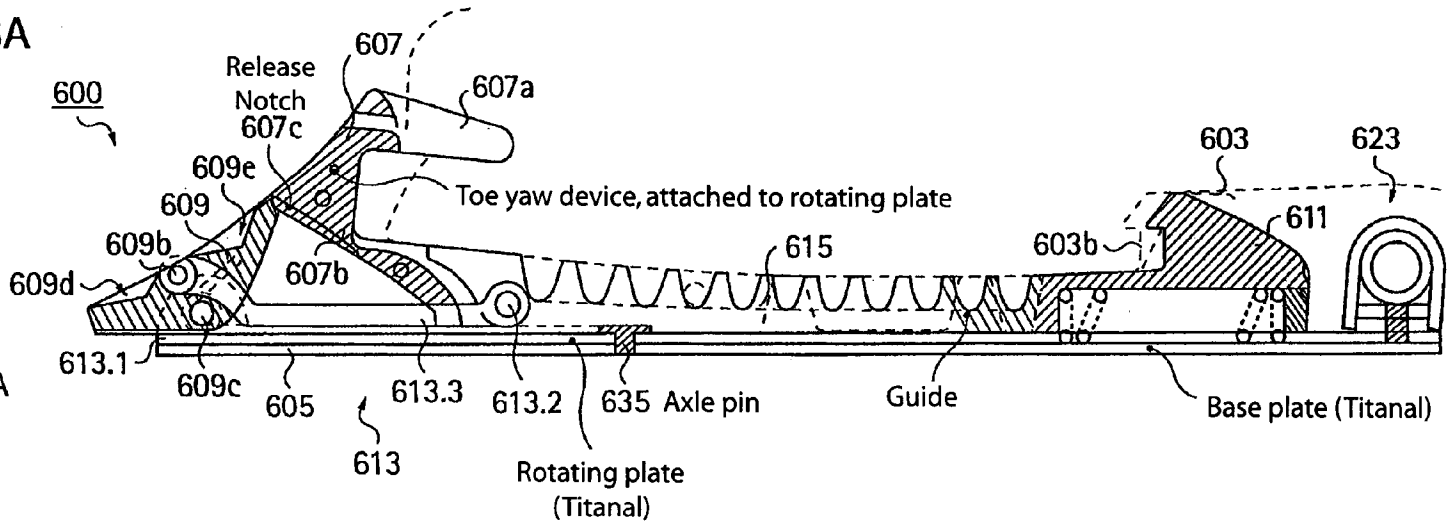
Figure 6B:
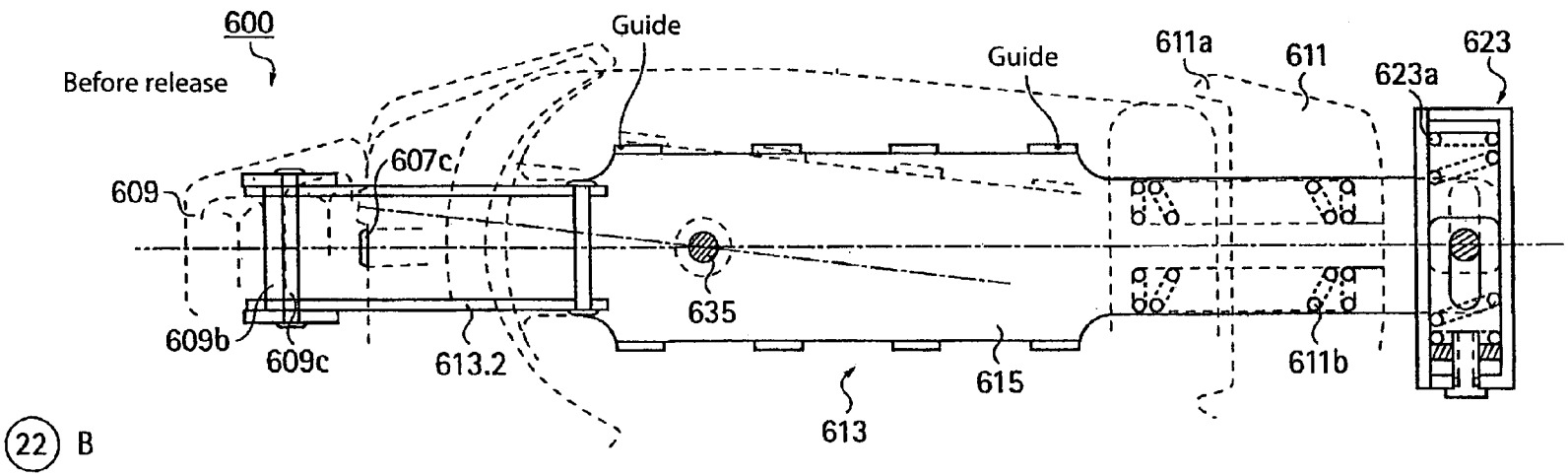
Figure 7A:
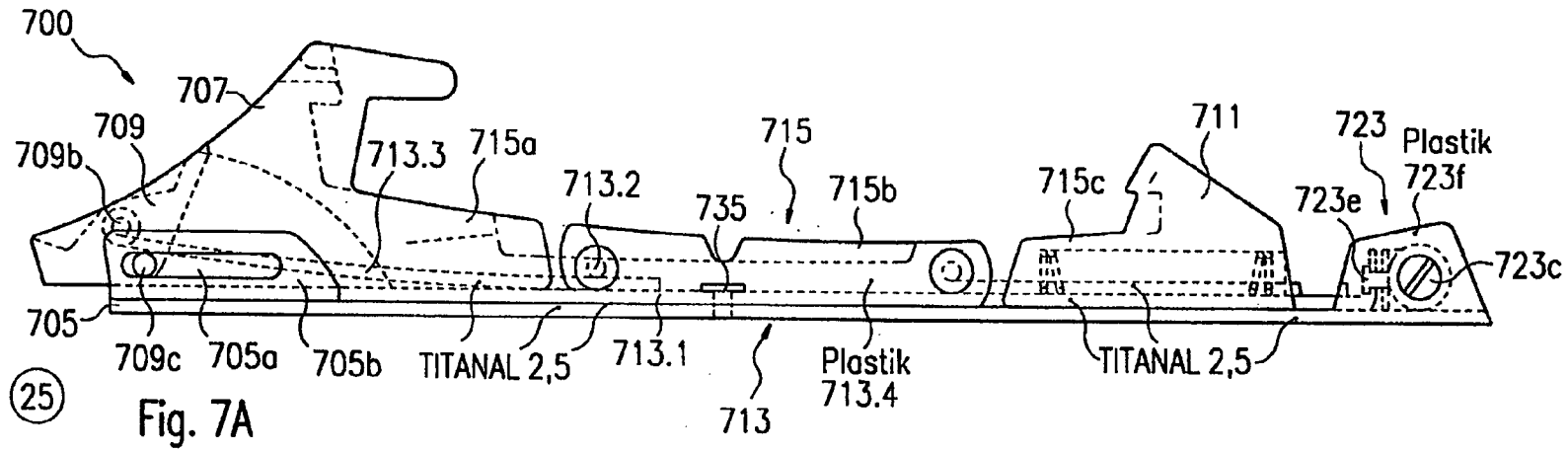
Figure 7B:
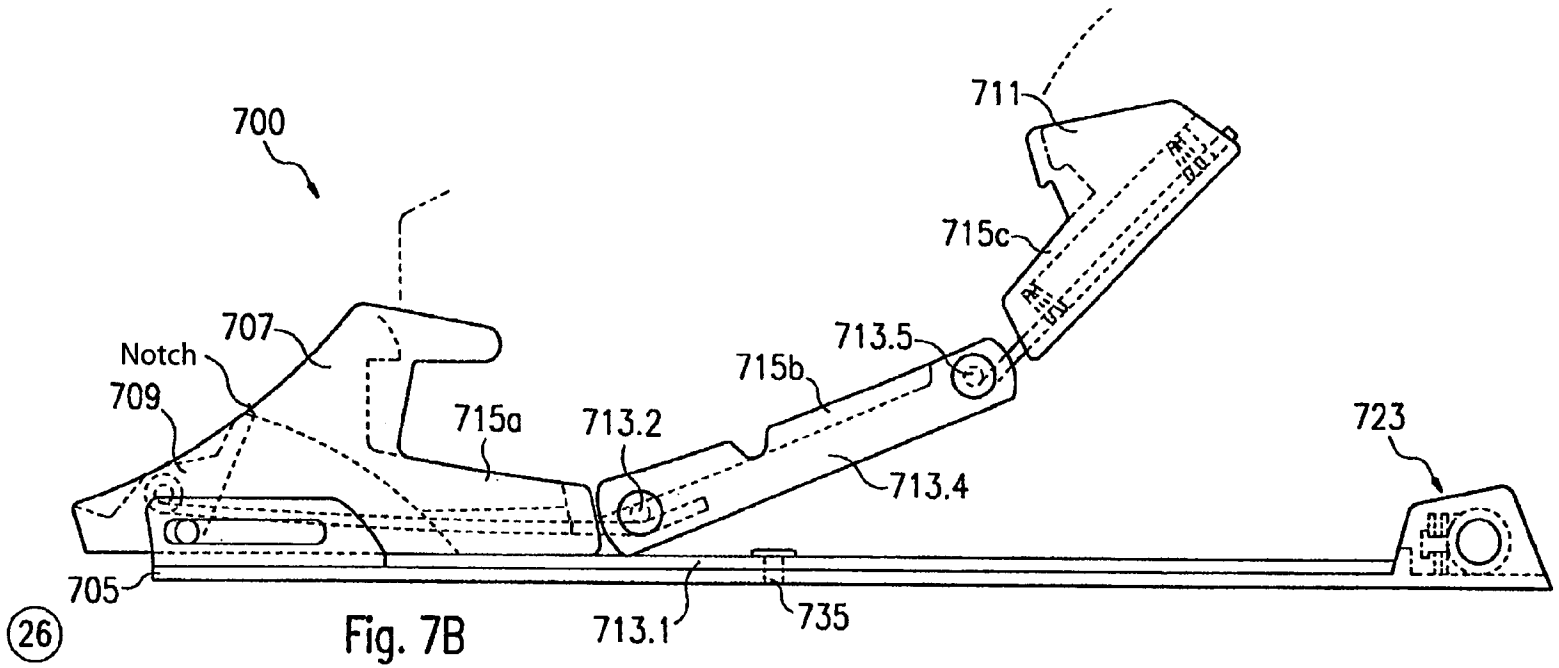
Figure 10A:
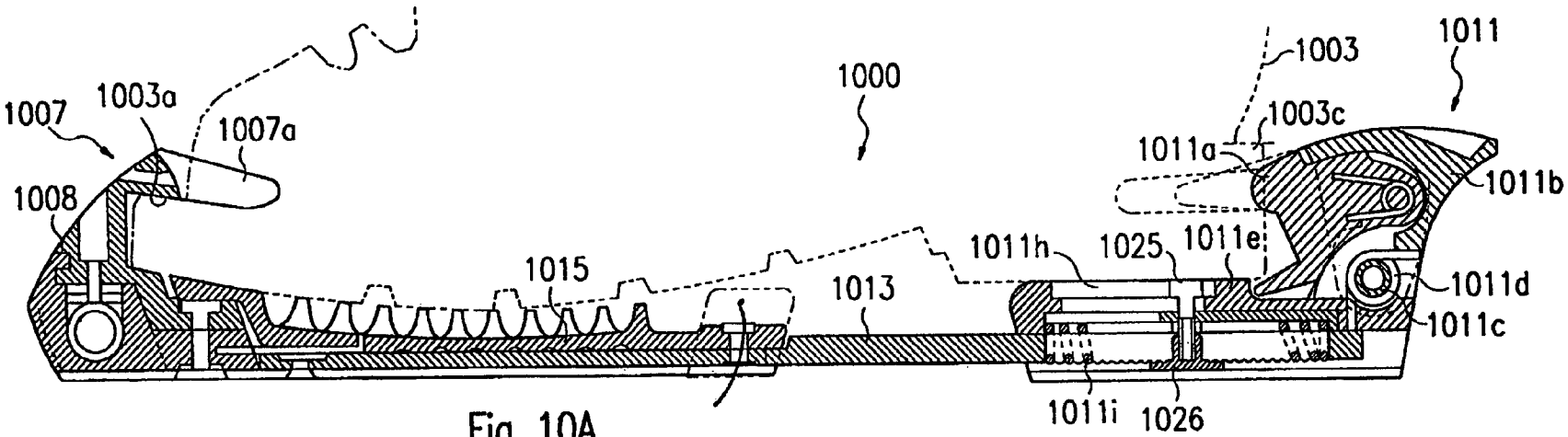
Figure 10B:
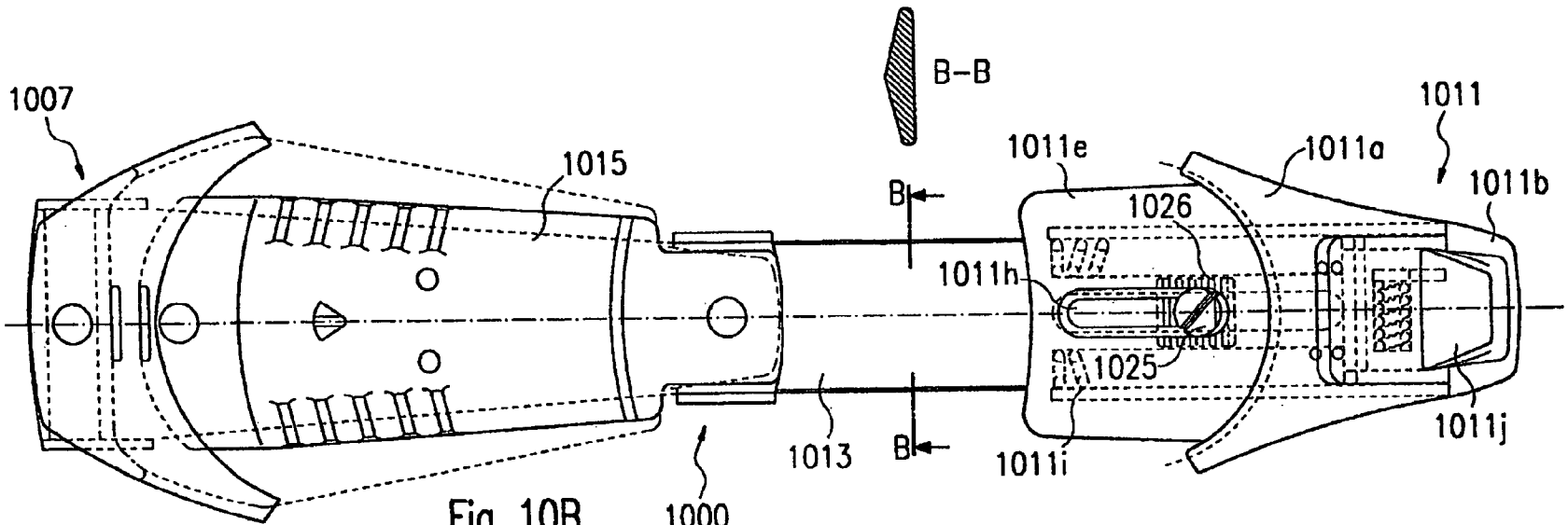
Figure 10C:
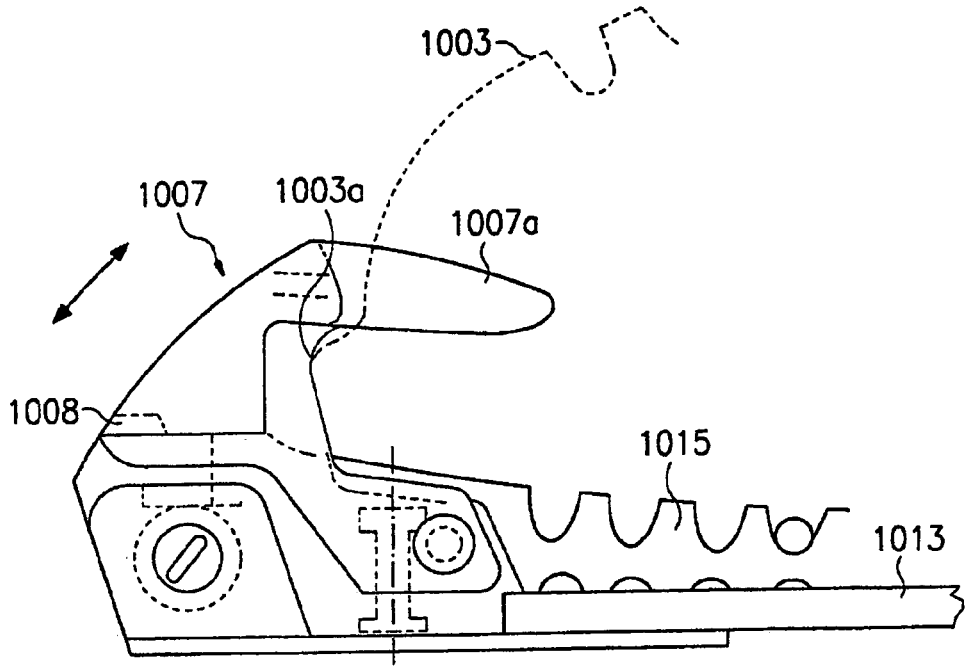
Figure 10D:
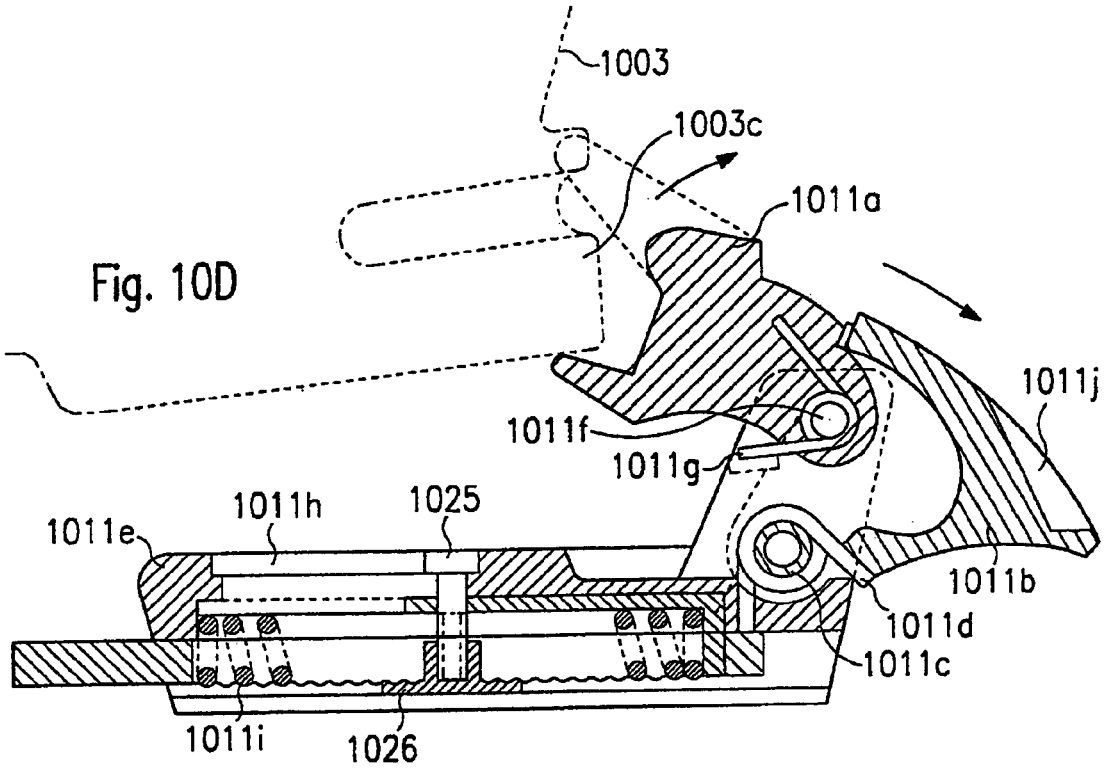
Figure 11:
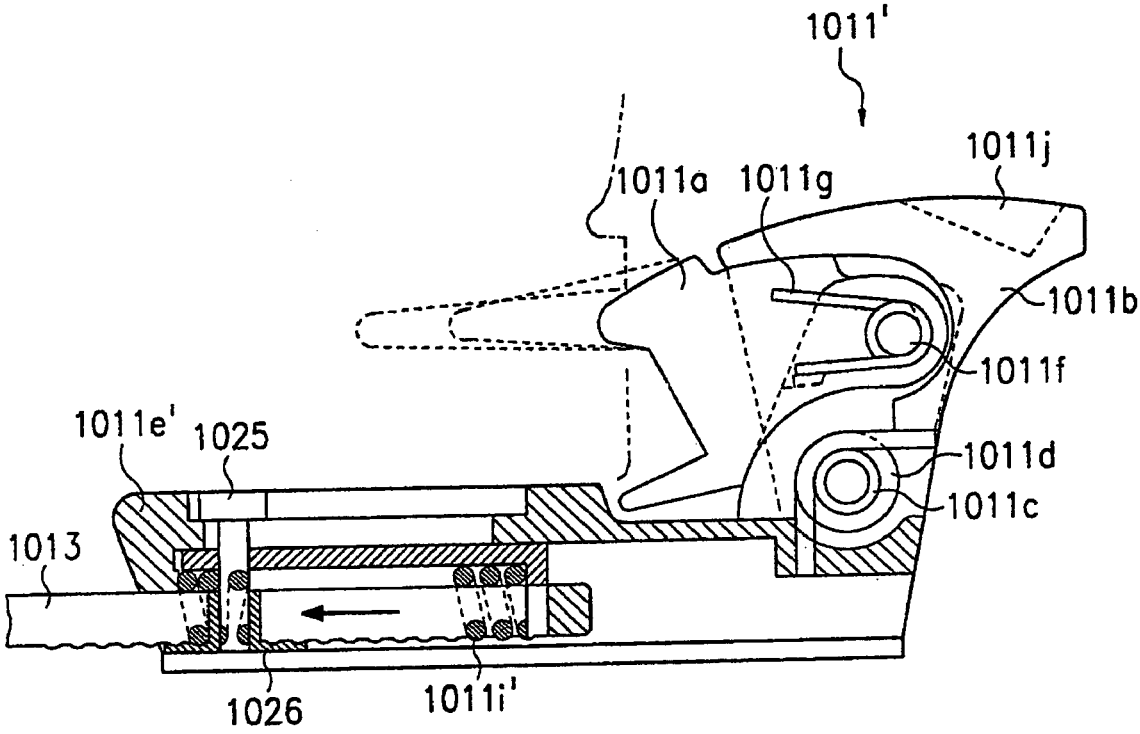

Other advantages and useful features of the invention will be apparent from the subordinate claims and from the following description of preferred exemplary embodiments with reference to the drawings, wherein FIGS. 1A to 1F show various views including sections and partial sections of a ski binding according to a first embodiment of the invention, FIGS. 2A to 2D are schematic sketches to explain the process of unlocking ski bindings in two further embodiments, FIGS. 3A and 3B are partially sectional views of another embodiment, slightly modified with respect to the embodiment shown in FIGS. 1A to 1F, FIGS. 4A to 4C are sectional sketches of parts of a ski binding according to another embodiment, FIGS. 5A and 5B are sectional views of a ski binding in another embodiment, such that the locking is done with the heel of the boot, FIGS. 6A and 6B are a sectional drawing (longitudinal section) and a diagram (plan view) to show the principles of operation of a ski binding according to another embodiment, FIGS. 7*a* and 7B are side views of another ski binding, modified from the embodiment shown in FIGS. 6A and 6B, in two different positions during use, FIGS. 8A to 8F are various sectional drawings, views and partially sectional drawings to explain the construction and the function of a ski binding according to another embodiment, FIGS. 9A to 9D are various drawings of a ski binding according to another, preferred embodiment, FIGS. 10A to 10D are various drawings of a ski binding according to another advantageous embodiment, namely a drawing in longitudinal section, a plan view and two detail views, and FIG. 11 is a detail sketch of the back retaining element of another embodiment, represented in longitudinal section.

FIGS. 1A to 1F show in various views and sectional representations a ski binding 100 according to a first embodiment of the invention, which is suitable for use as a touring, telemark or cross-country binding. It is shown as it appears when mounted on a ski (not shown); here, as in all the other figures, the tip of the ski is toward the left side of the drawing and the end is toward the right side. FIG. 1A shows a side view, FIG. 1B a plan view, and FIG. 1C a longitudinal section; FIG. 1D is a sketch in plan view with a section through part of the ski, FIG. 1E shows a longitudinal section in step-out position and FIG. 1F, a longitudinal section with the binding locked and the heel of the ski boot raised.

In some figures the ski surface is shown as a solid line 101 while a dashed line indicates the contour of the sole of a ski boot 103 adapted to the ski binding 100. The binding 100 comprises as essential functional units a mounting plate 105, a front retaining element 107 with associated actuating element 109, a back retaining element 111 and a tensioning device 113 that connects the front retaining element 107 to the back retaining element 111 and is covered by a supporting plate 115, and finally a heel-supporting element 117 and the ski brake 119. The structure and the manner of function of the heel-supporting element 117, as well as those of the ski brake 119, are of relatively slight importance in the context of explaining the invention and therefore are not described further in the following; the description concentrates on the front and back retaining elements 107, 111, the actuating element 109 and the tensioning device 113, as well as their interactions.

The front retaining element 107 has a plastic main body (not separately labelled) that tapers toward the back to form retaining jaws 107*a* designed to extend over and around a front sole end 103*a* of the ski boot 103. In the lower part of its front surface, toward the tip of the ski, the front retaining element 107 has a pressing and sliding area 107*b*, with a slightly concave surface that faces toward a correspondingly curved pressing and sliding surface 109*a* of the actuating element 109 and is in contact therewith. The main body of the front retaining element 107 rests—as can be seen in the sectional drawings—on a retaining-element base 121 and can be swiveled with respect thereto (in a way known in principle for downhill ski bindings) when force is applied from the side. A threshold adjustment and restoring action associated with this swiveling movement are implemented by a releasing-spring device 123 mounted in the base 121 of the retaining element.

The releasing-spring device 123 comprises (as can best be seen in FIG. 1D) as its crucial components a coil spring 123*a*, two angular coil-spring holders 123*b*, an adjustment screw 123*c* with pressure plate 123*d* and a sliding bolt 123*e* that engages the cover enclosing the coil spring 123*a*. (The releasing-spring devices in the embodiments described below have fundamentally the same structure, so that they need not be described in detail again with reference to these embodiments.)

The back retaining element 111 has a set of retaining jaws 111*a*, the shape of which is adapted to that of a projection 103*b* on the front part of the sole of the ski boot 103, so that when the boot is in position on the binding, the back retaining element extends over and around this projection. In the interior of the back retaining element 111 two coil springs 111*b* are held within two corresponding guide structures so that they act as compression springs, one end of each spring abutting aginst a bearing surface 111*c* of the back retaining element and the other end, against a bearing surface of the tensioning device 113 (described in detail below). In a flat upper surface 111*d* of the lower part (not distinguished in the figure) of the back retaining element 111 there is a slot 111*e* within which a connecting pin 125 slides to form a connection with the tensioning device.

The tensioning device 113 consists substantially of a flexible connecting plate, at the back end of which a raised edge 113*a* is formed, which constitutes the above-mentioned second bearing surface for the two coil springs 111*b* in the back retaining element 111. In the back section the connecting plate 113 passes through a corresponding slit-like aperture (not separately labeled) in the lower part of the back retaining element 111 in such a way that the latter can be freely shifted with respect to the connecting plate under the action of the coil springs 111*b*. At the front end of the connecting plate 113, supported in a corresponding bearing orifice, is an axle 113*b* that in turn rotatably supports one end of each of two pivoted levers 127. Their other ends are supported by another axle 109*b*, which in turn is rotatably mounted in the actuating element 109.

The actuating element itself can be swiveled about an actuating-element axle 109*c*, which is supported in the mounting plate 105. The actuating element 109 has two depressions 109*d*, 109*e* to direct the pressure exerted substantially from above, in particular by means of a ski pole, in order to produce a pivoting movement of the actuating element 109 about the axle 109*c*.

As can best be seen by comparing FIG. 1C or 1F with 1E, when a ski pole 129 is inserted into the depression 109*e* of the actuating element 109 and an appropriate pressure is applied, the end of the front retaining element 107 toward the actuating element 109 is caused to swivel downward, during which process the pressure and sliding surfaces 107*b* and 109*a* slide past one another. This swiveling movement swings the pivoted lever 127 up from an approximately horizontal into an approximately vertical position; that is, it is moved to a top-dead-center position.

This movement brings about a release of the tensioning device (connecting plate) 113 in the region of the actuating element, and under the action of the coil springs 111*b* the connecting plate 113 slides back until it strikes an abutment determined by the position of the pivoted lever 127 with respect to the actuating element 109. In so doing, it takes with it the back retaining element 111, which causes the latter to be released from the projection 103*b* in the front part of the boot sole (FIG. 1E). This situation is to be compared with the locked state of the connecting plate 113 with actuating element 109 shown in FIGS. 1A to 1C, in which the back retaining element 111 is engaged with the projection 103*b* of the front sole part by means of the retaining jaws 111*a*. To change to the latter state from the released state shown in FIG. 1E, pressure is applied to the actuating element in the region of the front depression 109*d*, which causes the actuating element to swivel back out of the position shown in FIG. 1E and into the position shown in FIG. 1C, carrying the connecting plate 113 forward with it by means of the pivoted lever 127.

The sketch in FIG. 1F shows how the compression spring 111*b* in the back retaining element 111 acts to compensate the flexion when the ski boot 103 is raised so as to bend the connecting plate 113 (as well as the supporting plate 115) when the binding is in the locked state.

FIGS. 2A to 2D, in which is sketched a ski binding slightly modified from the embodiment according to FIGS. 1A to 1F, illustrate the principle of releasing the binding when a lateral force or torsional load is imposed. The ski binding, here identified by the numeral 200, again comprises a mounting plate 205, a front retaining element 207, an actuating element 209, a back retaining element 211 and a tensioning device (flexible connecting plate) 213. With respect to the constructional details of these components reference is made to FIGS. 1A to 1F.

Here, again, a releasing-spring device 223 is provided, which is constructed analogously to the spring device 123 of FIGS. 1A to 1F and will not be described further here. In the individual FIGS. 2A to 2D the various states of tension of the spring device 223 in different movement phases or positions of the front retaining element 207 can readily be seen. FIG. 2A shows an intermediate position during release of the binding toward the right, and FIG. 2D shows the state when release toward the right has been completed, whereas FIG. 2C shows the state during imposition of a slight lateral force, i.e. in the initial phase of a releasing process, and FIG. 2B shows the state during release toward the left. It can readily be seen that the sliding bolt 223*e* of the spring device 223 acts as a displaceable center of rotation for the release processes.

In FIGS. 2C and 2D an elastomer block 231 is shown in partial section; its front surface is W-shaped so as to cooperate with an abutment plate 233 rigidly mounted at the base (not shown here) of the retaining element. It can be seen that during a release process, the elastomer block 231 is rotationally displaced along with the front retaining element 207, and when the release position is reached, the abutment plate 233 slides into one of the two depressions forming the "W", thus elastically holding the elastomer block itself and with it the front retaining element 207 initially in the release position. Rotation back into the starting position can be achieved by overcoming the elastic counterforce exerted by the elastomer block.

In FIG. 2A it can be seen that the rotational movement of the tensioning device (connecting plate) 213 that accompanies movement of the boot relative to the ski has its axis of rotation in the connecting pin 225, which connects the back retaining element 211 to the connecting plate 213 so that it can be both longitudinally displaced and rotated.

FIGS. 3A and 3B show a ski binding 300 modified from the embodiment according to FIGS. 1A to 1F inasmuch as instead of the flexible connecting plate, it comprises a jointed connecting plate 313. In FIG. 3A, the binding is shown as it appears when the boot is resting on the ski with lowered heel, whereas in FIG. 3B raising of the boot heel has brought the binding into the flexed position. The tensioning device or connecting plate 313 here consists of three parts 313*a*, 313*b* and 313*c*, which are rotatably connected to one another by means of axial hook connectors (not shown here). In other respects the construction is the same as in the first embodiment, so that the same reference numerals are used here and no further description is needed.

In FIGS. 4A to 4C a ski binding 400 according to another embodiment of the invention is sketched in the form of vertical (FIGS. 4A and 4B) or horizontal partial sections. This ski binding 400 is likewise adapted to a ski boot (here identified by the numeral 403) equipped with a process on the front part of its sole for the purpose of locking it in place. The structure of the front retaining element 407, including the releasing-spring device 423, and of the supporting plate 415 corresponds to that in the embodiments previously described.

The back retaining element 411, as in the previous embodiments, is associated with a compression-spring mechanism comprising two coil springs 411*b* as central active elements, which by means of a pivoted-lever mechanism (not shown in detail in FIGS. 4A to 4C) brings about both a compensation for flexion and a similarly directed change in the longitudinal position and angle of inclination of the back retaining element. As a result, the retaining element is either locked behind the projection 403*b* of the front part of the boot sole (FIG. 4A) or unlocked therefrom (FIG. 4B).

Here, again, the actuating element 409 has a pressure and sliding surface 409*a* that can slide along a corresponding concave (in the form of a round cylinder) surface of the front retaining element 407; it can thus be swiveled about an axle 409*c* of an actuating element oriented parallel to the ski surface and perpendicular to its long axis, so that it rotates back and forth between the positions shown in FIG. 4A and in FIG. 4B. Swiveling downward into the release position is, for example, again brought about by placing a ski pole 429 on the element 409 and exerting moderate downward pressure in a (in this case single) depression 409*d*. Associated with the axle 409*c* is a torsion spring 409*f*, which counteracts this swiveling movement and tends to rotate the actuating element back into the position shown in FIG. 4A.

The ski binding 400 comprises a tensioning device or connecting plate 413, which has at its back end abutment surfaces 413*a* for the coil springs 411*b* in the back retaining element 411 and at its front end an axle 413*b* seated in a corresponding orifice. Because of its eccentric arrangement with respect to the actuating-element axle 409*c*, swiveling of the actuating element 409 is accompanied by longitudinal displacement of the connecting plate 413. By this means the above-mentioned similarly directed displacement and swiveling of the back retaining element 411 is achieved. The swiveling mechanism of the back retaining element 411 includes suitable locking means, which allow it to be self-locking after the boot has been placed in the binding so that the sole presses against the upper surface of the retaining element. As a result, while skiing cross-country or downhill in telemark style the boot can be raised without causing the back retaining element to be released (cf. also the description of FIGS. 8A to 8F below).

FIGS. 5A and 5B are sketches to show the principle underlying another ski binding 500, which in contrast-to the embodiments previously described engages the boot not at the front part of the sole, but rather behind the heel 503*c* of the boot 503.

The front actuating element 507 here comprises an upper set of retaining jaws 507*a* as well as a lower set of jaws 507*a*', disposed at the level of the supporting plate 505 and enclosing its front region in a U-shape. The front retaining element 507 comprises a releasing-spring device 523 similar to that in the embodiment described above, but here it is rotated by 90° and disposed in the lower section of the integrally constructed retaining element. Position and shape of a back retaining element 511 with two sets of retaining jaws 511*a* and 511*a*' are here adapted to the modified principle of locking by engagement with the heel of the boot. The retaining element 511 is likewise associated with a displacement mechanism under spring tension having two compression-spring elements 511*b*, which are braced at one end against an abutment surface of the retaining element and at the other end against an abutment surface of the tensioning device (neither of which is separately identified here). Here, again, a guide means 525/511*e* in the form of a pin-and-slot combination is provided, to connect the back retaining element displaceably to the tensioning device 513.

The binding 500 comprises a tensioning device 513 consisting of several parts, most importantly a front connecting plate 513.1 with a hook-shaped raised edge 513.1*a* at its most forward end, a supporting plate 515 attached thereto by means of two screws 513.2, and a back connecting plate 513.3 likewise attached to the front plate, by means of the pin 525. At the outermost back end of the latter are provided L-shaped downward-directed edges 513.3*a* against which the coil springs 511*b* are braced.

The actuating element 509 is only roughly sketched in FIGS. 5A and 5B; as shown there it comprises in a first part 509.1 an actuating-element axle 509*c* seated in the mounting plate 505, and in a second part 509.2 a second axle 509*b*. On the upper surface of the actuating element 509 is a depression 509*d* in which to place the tip of a ski pole (not shown). In this embodiment, too, exerting the required pressure causes the actuating element to rotate about its axle 509*c*, as a result of which in this case the front hook-like edge 513.1*a* is released and the tensioning device 513 is pressed backward, along with the back retaining element 511, by the force of the compression springs 511*b*. The latter thereby releases the heel 503*c*, and the binding is unlocked from the boot.

In the middle region of the tensioning device 513, seated in the mounting plate 505, is provided a pin 535 that is guided within a slot 513.1*b* in the front of the connecting plate 513.1 and serves as a rotational bearing for swiveling the tensioning device (together with the ski boot when a torsional force is acting). As shown by the dashed lines in FIG. 5B, during such a swiveling movement the hook-like upturned edge 513.1*a* at the front end of the front connecting plate 513.1 rotates about the pin 535 with respect to the second part 509.2 of the actuating element 509, turning to the side so that the latter is no longer engaged with the hook 513.1*a* and the tensioning device as a whole can be pressed backward by the compression springs 511*b*. In this case, again, the locking mechanism is thereby released, in such a way as to implement the function of a safety release under the action of a lateral force or torsional load.

FIGS. 6A and 6B show a touring, telemark or cross-country binding 600 according to another embodiment of the invention.

The structure of the actuating element 609 and its connection to the tensioning device 613 resemble those in the embodiments according to FIGS. 1A to 1F and 4A to 4C. On the upper surface of the actuating element two depressions 609*d*, 609*e* are provided, an actuating-element axle 609*c* is disposed in turned-up edges at the sides of the mounting plate 605, and the connection to the connecting device is brought about by an axle 609*b* disposed in a corresponding orifice at the front end thereof.

The connecting device 613 here comprises a connecting or rotating plate 613.1, two levers 613.3 that create the connection between the actuating elements 609 and the supporting plate 615 (by way of an axle 613.2 provided there), and the supporting plate 615 itself. The releasing-spring device 623, the equivalent of which was provided in the region of the associated front retaining element in the embodiments previously described, is disposed at the back end of the connecting device 613 in the present embodiment. It is fixedly mounted on the mounting plate 605, and the back end of the rotating plate 613.1 engages the coil spring 623*a* around its circumference. By this means the release characteristics are adjusted.

The back actuating element 611 comprises, in a manner described above for other embodiments, a set of retaining jaws 611*a* and a spring device with two compression springs 611*b* to implement a compensation for flexion and to place the binding under tension around a projection 603*b* at the back end of the front part of the sole of the boot 603. Hence in this regard reference can be made to the relevant preceding parts of the description. In the central region of the binding here, as in the embodiment according to FIGS. 5A and 5B, an axle 635 is provided about which the entire connecting device 613 can be rotated.

The front retaining element 607 here has a narrow region of contact, i.e. a lug 607*c*, with the back edge of the actuating element 609. When the connecting device is rotated (together with the back retaining element 611) about the axle 635, the lug 607*c* becomes disengaged from the actuating element, and the connecting device 613—including the actuating element, which slides along the sliding surface 607*b* of the front retaining element 607—is pulled backward by the force of the springs 611*b*. This implements the safety release of the binding.

The ski binding 700 shown as another embodiment in FIGS. 7*a* and 7B corresponds substantially to the embodiment according to FIGS. 6A and 6B and in particular has the same releasing functions. An additional feature clearly illustrated here is the lateral guidance of the actuating element 709 by means of its axle 709*c*, which moves along guide slots 705*a* cut into upright edges 705*b* of the mounting plate 705 (these can also be present in similar arrangement in the previously described embodiment, but are not shown there).

The releasing-spring device 723 in this embodiment has a separate plastic housing 723*f*, in which it is disposed—in a manner similar to that in the embodiment according to FIGS. 5A and 5B, but in this case not in the region of the front retaining element—so that the long axis of the sliding bolt 723*e* is parallel to the surface of the ski.

The main difference from the embodiment according to FIGS. 6A and 6B is that a modified tensioning device 713 comprises not only a titanal rotating plate 713.1, a first axle 713.2 and a front connecting plate 713.3 connecting the latter to an axle 709*b* on the actuating element 709, but also a middle connecting plate 713.4, which accommodates in addition to the first axle 713.2 at the front end a second axle 713.5 at its back end, and a back connecting plate 713.6 connected to this axle. Whereas the middle connecting plate 713.4 is an integral part of a middle section 715*b* of a supporting plate 715, the front section 715*a* of the latter is integral with the front retaining element 707 and its back section 715*c* is integral with the back retaining element 711, through which passes the back connecting plate 713.6 of the tensioning device. As can be seen in FIG. 7B, in this embodiment the tensioning device 713 and the individual sections of the supporting plate 715 move in a manner similar to those in the embodiment according to FIGS. 3A and 3B—with the difference that in the latter case the supporting plate comprised one continuous piece.

Another embodiment of the ski binding 800 in accordance with the invention is sketched in various views and sections in FIGS. 8A to 8F. This binding, again, comprises a mounting plate 805, a front retaining element 807 with associated actuating element 809, a back retaining element 811 and a tensioning device 813 as well as a supporting plate 815. In addition a ski brake 819 is provided, which however, because it is of little relevance to the invention, is not described further in the following. Finally, a releasing-spring device 823 is also provided here.

With respect to the construction of the front retaining element 807 and the actuating element 809 as well as its cooperation with the tensioning device 813, the present ski binding 800 resembles to some extent the binding 500 shown in FIGS. 5A and 5B and described above, so that in these respects there is no need to repeat a detailed description. The similarity relates in particular to the presence of a connecting plate 813.1, which at its front end in the region of the actuating element 809 terminates in a narrow hook 813.1*a*. Here, however, the connecting plate is not simultaneously a rotating plate but rather is connected to a rotating plate 813.7 provided as a separate component; which in turn engages the sliding bolt 823*e* of the releasing-spring device 823 (which here is displaced backward, into the vicinity of the back retaining element 811).

In the region of the front retaining element 807 the supporting plate 815 is screwed to the connecting plate 813.1, which is constructed as a sliding plate. Regarding the function during manually actuated release of the boot as well as during safety release under the action of a torsional force, the connecting device, the actuating element and the front retaining element correspond largely to the arrangement according to FIGS. 5A and 5B described above. However, it should be noted that a torsion spring 809*f* (not shown in FIGS. 5A and 5B) is also provided, for pretensioning the actuating element 809 and returning it to the initial position shown in FIG. 8A.

It is worth emphasizing the construction of the back retaining element 811 in the binding 800. As in the previously described embodiments, it comprises a coil-spring arrangement for pretensioning. Here, however, the spring is actuated by way of the supporting plate 815, which projects into the region of the back retaining element and there contains a slot 815*a*, within which a connecting pin 825 produces a slidable connection to the upper surface of a retaining-element base 811.1.

Supported pivotably in the base, by way of an axle 811.2 seated transverse to the long axis of the ski in a slot 811.3 in the retaining-element base 811.1, is a locking lever 811.4 which bears a set of retaining jaws 811.4*a* and a central lug 811.4*b*. At its end opposite the axle 811.2, the jaws 811.4*a* and the lug 811.4*b*, the locking lever 811.4 has a detent section 811.4*c*, which cooperates with a lug 811.1*a* provided at the back edge of the retaining-element base 811.1. Disposed around the axle 811.2 is a torsion-spring element 811.5, which presses the locking lever 811.4 against the retaining-element base 811.1 when the binding is in the opening position shown in FIG. 8A.

When a boot is set into the binding, the projection (not separately labelled here) on the front part of the boot sole presses the lug 811.4*b* and hence also the locking lever 811.4 downward, against the force of the torsion-spring element 811.5, and ultimately into the position shown in FIG. 8E. It is evident that in this process the locking lever 811.4 has shifted with respect to the retaining-element base 811.1 owing to movement of the axle 811.2 within the guide slot 811.3, so that the detent section 811.4*c* has slid upward and backward, over the lug 811.1*a* on the retaining-element base 811.1, and is arrested there as long as the retaining jaws 811.4*a* are locked behind the projection on the front part of the boot sole. As a result, it is possible to raise the heel of the boot while travelling cross country or downhill in telemark style without unlocking it from the back retaining element.

When a lateral or torsional force is acting or the binding is intentionally actuated for removal of the boot, after the engagement between the second part 809.2 of the actuating element 809 and the hook 813.1*a* is released by turning the rotating plate 813.7 about the axle 813.2 or swiveling the actuating element 809, respectively, the back retaining element slides backward together with the sliding plate 813.1 and the supporting plate 815 under the action of the compression springs 811*b*, far enough that the engagement between the lug 811.1*a* and the detent section 811.4*c* is broken. As a result, the projection on the front part of the boot sole is released, so that the boot can be removed from the binding.

In FIGS. 9A to 9D another ski binding 900 is described, which unites elements of the embodiment just described according to FIGS. 8A to 8F with those in other embodiments described previously. Here the function of the back retaining element 911 is the same as in the immediately preceding embodiment, so that in this regard reference should be made to that description. The restoring-spring arrangement 923 here is in the same position as in the embodiment according to FIGS. 5A and 5B, described further above.

The binding 900 comprises an elongated front retaining element 907, into which a front supporting plate 915.1 is integrated. The latter comprises two coarsely studded lateral supporting surfaces, one on either side of a tensioning device 913 integrated with a back supporting plate 915.2. The tensioning device 913 comprises, in addition to the back supporting plate 915.2, which creates the connection to the back retaining element 911, a front connecting plate 913.1, which at its front end in the region of the actuating element 909 terminates in a hook 913. The connecting plate 913.1 is screwed to the back supporting plate 915.2 by way of an upright edge 913.1*c*. The cooperation of the connecting device 913 with the actuating element 909 corresponds substantially to the descriptions given above regarding FIGS. 5A and 5B as well as FIGS. 8A to 8F, to which reference is made here.

A special feature of the present embodiment resides in the presence of a compression-spring arrangement 935 below the back supporting plate 915.2, which comprises an elongated coil spring 935*a*, braced at one end against the mounting plate 905 and at the other end against the front connecting plate 913.1, and contains an internal guide rod 935*b*. This arrangement serves to return the connecting device 913 to its initial position, or to put it into a longitudinal position corresponding thereto (from which it can then be returned to the original position by swiveling), after actuation or release has occurred. The axle 913.2 of the connecting device 913 here is in a different location, having been moved behind the compression-spring arrangement 935 toward the back retaining element 911.

In a modification (not shown here) of the last-mentioned embodiment the front connecting plate 913.1 is made flat, without an upright edge at its back end, and in the flat part is screwed to a back connecting plate which in turn is screwed to the back retaining element but does not necessarily act as a supporting plate for the sole of the boot. The ski boot can rest on only two supports, namely the front supporting plate connected to the front retaining element, and side walls of the part of the back retaining element facing toward the tip of the ski.

In FIGS. 10A to 10D, as another embodiment of the invention, is sketched a ski binding 1000 that can be used with commercially available telemark ski boots 1003. In view of the extensive descriptions given for the preceding embodiments, here only the components or aspects that differ from those will be explained. Components analogous or corresponding to those in the preceding embodiments are also identified by corresponding reference numerals and are mostly not explained in detail here; furthermore, not all details in FIGS. 10A to 10D are identified by reference numerals.

The ski binding 1000 likewise comprises a front retaining element 1007, a back retaining element 1011, which here engages the heel 1003*c* of the boot, a tensioning device (connecting plate) 1013 and a profiled supporting plate 1015.

The structure of the front retaining element 1007 to a certain extent corresponds to that of the front retaining element 107 in FIGS. 1A to 1F, but here a special actuating element is eliminated. Instead, a tongue-and-groove arrangement 1008 at the front edge of the front retaining element 1007 ensures that when the boot has swiveled far enough for its tip to reach a predetermined angle (release angle), the retaining jaws 1007*a* are raised and the front end 1003*a* of the sole is released. Hence the process of actuating the binding for release is in this case carried out at the back retaining element.

The back retaining element 1011 therefore differs fundamentally from those in all embodiments previously described. It of course comprises a set of retaining jaws 1011*a* associated with a back actuating element 1011*b*. The latter is attached to a retaining-element base 1011*e* by way of a first axle 1011*c* with an associated torsion-spring element 1011*d*. The retaining jaws 1011*a* in turn are connected to the actuating element 1011*b* by a second axle 1011*f* with an associated torsion-spring element 1011*g*.

The entire back retaining element 1011 is joined to the connecting plate 1013 in a manner known in principle from some of the embodiments previously described (in particular according to FIGS. 5A and 5B). The connection comprises in particular a connecting screw 1025, which extends through a slot 1011*h* in the retaining-element base 1011*e* and is screwed into a sliding piece 1026 that is guided within the retaining-element base 1011*e*. The combined action of these components allows the back retaining element 1011 to shift longitudinally on the connecting plate 1013 (and thus with respect to the front retaining element 1007) for a distance of preferably ca. 70 mm.

When the heel of the boot 1003 is raised, the connecting screw 1025 can slide in the slot 1011*h*—as in the embodiment according to FIGS. 5A and 5B—against the force exerted by coil springs 1011*i* held in corresponding guide means in the retaining-element base. In this way a bending (flexion) compensation amounting preferably to ca. 30 mm is implemented.

As can best be seen in FIG. 10D, to remove the boot from the binding pressure is applied from above in a depression 1011*j* on the upper surface of the back actuating element 1011*b*, so that the latter swivels backward against the force of the torsion spring 1011*d*, about the axle 1011*c* at the retaining-element base 1011*e*. In the process it carries along the retaining jaws 1011*a*, to which it is connected by way of the axle 1011*f*, until the jaws disengage from the heel 1003*c* of the boot and thus release the latter.

In FIG. 11 is shown a modified embodiment 1011' of the back retaining element, which in structure and function most closely resembles the retaining element 1011 described above with reference to FIGS. 10A to 10D. Insofar as applicable, identical reference numerals are used here. The substantial difference resides in the different designs of the retaining-element base 1011*e*' and the coil springs 1011*i*', which here are made shorter so that they permit the above-mentioned compensation for flexion but do not allow any length adjustment.

The implementation of the invention is not restricted to the examples described above but is also possible in a large number of further modifications, which in particular can be formed by combinations of individual components and/or functions of the embodiments presented here.

LIST OF REFERENCE NUMERALS

100; 200; 300; 400; 500 600; 700; 800; 900; 1000 Ski binding
101 Upper surface of ski
103; 403; 503; 1003 Ski boot
103*a*; 1003*a* Front end of sole
103*b* Projection on front of sole
105; 205; 305; 505; 705; 805 Mounting plate
107; 207; 307; 407; 507; 607; 707; 807; 907; 1007 Front retaining element
107*a*; 407*a*; 507*a*; 507*a*'; 607*a*; 807*a*; 1007*a* Retaining jaws
107*b* Concave pressure and sliding surface
109; 209; 309; 409; 509; 609; 709; 809 Actuating element
109*a*; 409*a* Pressure and sliding surface
109*c*; 409*c*; 509*c*; 809*c* Axle of actuating element
109*d*; 109*e*; 409*d*; 509*d*; 609*d*; 609*e* Depression
111; 211; 311; 411; 511; 611; 711; 811; 911; 1011; 1911' Back retaining element
111*a*; 411*a*; 511*a*; 511*a*'; 811.4*a*; 1011*a* Retaining jaws
111*b*; 1011*i* Coil spring
111*c* Bearing surface
111*d* Upper surface
111*e*; 511*e*; 1011*h* Slot
113; 213; 313; 413; 513; 613; 713; 813; 913; 1013 Tensioning device (connecting plate)
113*a*; 413*a* Upright edge (bearing surface)
113*b*; 109*b*; 413*b*; 509*b*; 809*b* Axle
115; 315; 415; 515; 615; 715; 815; 915; 1015 Supporting plate
117 Heel-support element
119; 819 Ski brake
121 Retaining-element base
123; 223; 423; 523; 623; 723; 823 Releasing-spring device
123*a* Coil spring
123*b* Angular coil-spring retaining holder
123*c*; 723*c* Adjustment screw
123*d* Pressure plate
123*e*; 223*e*; 723*e*; 823*e* Sliding bolt
125; 225; 525 Connecting pin or screw
127 Pivoted lever
129; 429 Ski pole
231 Elastomer block
233 Bearing plate
313*a*, 313*b*, 313*c* Parts of connecting plate
409*f*; 809*f* Torsion spring
503*c*; 1003*c* Heel of ski boot
509.1; 809.1 First part
509.2; 809.2 Second part
513.1; 713.3 Front connecting plate
513.1*a*, 813.1*a*; 913.1*a* Hook (hook-shaped upturned edge)
513.1*b* Guide slot
513.2 Screw
513.3; 713.6 Back connecting plate
535; 635; 735; 835; 935 Pin (axle)
607*c* Contact region (lug)
613.1; 713.1; 813.1; 913.1 Connecting and/or rotating plate
613.2; 713.2; 713.5 Axle

613.3 Lever
715*a*, 715*b*, 715*c* Sections of the supporting plate
723*f* Plastic housing
815*a* Slot
811.1; 1011*e*; 1011*e*' Retaining-element base
811.1*a* Lug
811.2; 1011*d*; 1011*f* Axle
811.2 Slot
811.4 Locking lever
811.4*b* Lug
811.4*c* Detent section
811.5; 1011*d*; 1011*g* Torsion-spring element
913.1*c* Upright edge
915.1, 195.2 Front, back supporting plate
935 Compression-spring arrangement
935*a* Coil spring
935*b* Guide rod
1008 Tongue-and-groove engagement device
1011*b* Back actuating element
1026 Sliding piece

What is claimed is:

1. A ski binding for securing a ski boot to a ski comprising:

a front retaining element for engagement with the front end of the boot;

a back retaining element for engagement with the heel of the boot;

a tensioning device connecting said front and back retaining elements and locking said front and back retaining elements to the ski boot while allowing the heel of the boot to be raised from the ski; and a first release mechanism for releasing the lock between the ski binding and ski boot upon experiencing a laterally directed force and a second release mechanism releasing the lock when pressure is applied to an actuating element with first and second release mechanisms having a first locking element, connected to said tensioning device so that said first locking element cannot rotate with respect to said tensioning device, but can rotate about a first axis perpendicular to the ski surface, and a second locking element movable between a locked and unlocked state and which in the locked state is in form-fitting engagement with said first locking element and is nonrotatable about said first axis and is rotatable about a second axis oriented substantially parallel to the ski surface and perpendicular to the long axis of the ski, whereby rotation of said second locking element relative to the first locking element causes disengagement of said locking elements.

2. A ski binding according to claim 1 wherein said back retaining element comprises a set of retaining jaws extending over a portion of the heel of the boot.

3. Ski binding according to claim 1, characterized in that an actuating element is connected to the second locking element in such a way that applying pressure to the actuating element causes the engagement between the first and second locking elements to be released.

4. A ski binding according to claim 3, wherein said actuating element is operatively connected to said second locking element so that applying pressure to the actuating element causes the engagement between said first and second locking elements to be released.

5. A ski binding according to claim 3, further comprising a spring device operatively connected to said retaining element to apply tension to said retaining elements when said retaining elements are locked to the ski boot.

6. A ski binding according to claim 3, further comprising a front spring device located between said front and the back retaining element and operatively connected to said first locking element so as to apply tension to said first locking element when engaged with said second locking element, and a back spring device located at the back retaining element and cooperating with said front spring device to apply tension to said back retaining element when the said back retaining element is engaged with the boot, such that the spring force exerted by the back spring device is greater than that of the front spring device.

7. A ski binding according to claim 3, wherein said front retaining element comprises a set of retaining jaws extending over the front end of the ski boot.

8. A ski binding according to claim 3, wherein said tensioning device comprises an elastic planar connecting part elastically movable in a plane corresponding to a longitudinal section of the ski binding, so as to provide a rotationally stable connection of said front retaining element to said back retaining element.

9. A ski binding according to claim 3, wherein said first release mechanism to release the locking of the ski binding to the ski boot under the action of laterally directed force comprises elastic restoring means to compensate small lateral forces.

10. A ski binding according to claim 3, wherein said actuating element comprises a torsion-spring element and/a lever device comprising a pivoted lever.

11. A ski binding according to claim 3, wherein said front retaining element comprises a supporting plate engaging the front part of the boot.

12. Ski binding according to claim 5, characterized in that between the front and the back retaining element is provided a front spring device to apply tension to the first locking element when the latter is engaged with the second locking element, and at the back retaining element is provided a back spring device that cooperates with the front spring device to apply tension to the back retaining element when the latter is engaged with the front part of the boot sole or the heel of the boot, such that the spring force exerted by the back spring device is greater than that of the front spring device.

13. A ski binding according to claim 6, wherein said front spring device comprises a coil spring with a long stroke, braced at one end against a binding-mounting plate and connected at the other end to said release mechanism, in the form of a compression spring with internal guide rod.

14. A ski binding according to claim 6, characterized in that the back spring device comprises two short-stroke coil springs, which are disposed symmetrically with respect to the long axis of the binding, each in a guide channel.

15. Ski binding according to claim 6, characterized in that the back retaining element is connected like a lever to the back spring device, such that actuation of the retaining element when the boot is set into the binding is brought about behind a projection on the front part of the boot sole, against the spring tension generated by the back spring device.

16. Ski binding according to claim 6, characterized in that the planar connecting part is attached to the front and back spring devices in such a way that, at least in the unlocked state, it connects the front and back retaining elements flexibly to one another.

17. Ski binding according to claim 6, characterized in that the spring means for flexion compensation are implemented by the back spring device.

18. A ski binding according to claim 8, further comprising a binding case attached to the ski and having side walls that enclose the side edges of said connecting part, with said side walls having longitudinal ribs or grooves that cooperate with corresponding longitudinal grooves or ribs on said connecting part.

19. A ski binding according to claim 8, further comprising a ski brake attached to an upper surface of said planar connecting part in such a way that when a ski boot that has been resting on the connecting part is raised the brake is lifted along with the boot and connecting part, and is inactive.

20. A ski binding according to claim 9 wherein said elastic restoring means comprises an adjustable release spring.

* * * * *